US005189232A

United States Patent [19]

Shabtai et al.

[11] Patent Number: 5,189,232

[45] Date of Patent: Feb. 23, 1993

[54] METHOD OF MAKING JET FUEL COMPOSITIONS VIA A DEHYDROCONDENSATION REACTION PROCESS

[75] Inventors: Joseph S. Shabtai; Alex G. Oblad; Chi H. Tsai, all of Salt Lake City, Utah

[73] Assignee: University of Utah, Salt Lake City, Utah

[21] Appl. No.: 722,106

[22] Filed: Jun. 27, 1991

[51] Int. Cl.[5] ..... C10L 1/16; C07C 2/54

[52] U.S. Cl. ..... 585/14; 585/723; 585/730; 585/731

[58] Field of Search ..... 585/14, 721, 723, 730, 585/731

[56] References Cited

U.S. PATENT DOCUMENTS

| | | | |
|---|---|---|---|
| 3,773,652 | 11/1973 | Dille et al. | 585/14 |
| 4,286,109 | 8/1981 | Norton et al. | 585/14 |
| 4,604,490 | 8/1986 | Yuasa et al. | 585/21 |
| 4,812,146 | 3/1989 | Jessup | 585/14 |
| 5,076,813 | 12/1991 | Alberici et al. | 585/14 |

FOREIGN PATENT DOCUMENTS

| | | | |
|---|---|---|---|
| 0943896 | 3/1974 | Canada | 585/14 |

*Primary Examiner*—Anthony McFarlane
*Attorney, Agent, or Firm*—Trask, Britt & Rossa

[57] ABSTRACT

A method of making jet fuel compositions from lower alkyl cyclopentanes and $C_5$–$C_8$ olefins via a dehydrocondensation reaction in the presence of sulfuric acid or hydrofluoric acid. The reaction product contains a predominance of decalins and has high density, high heat of combustion and low freezing point.

11 Claims, 6 Drawing Sheets

METHOD OF MAKING JET FUEL COMPOSITIONS VIA A DEHYDROCONDENSATION REACTION PROCESS

This invention was made with government support under Grant number 19-55980-V awarded by the U.S. Air Force. The Government has certain rights in the invention.

BACKGROUND OF THE INVENTION

State of the Art

Although decalins and other bi- and polycyclic naphthenes have been recognized as excellent potential components of high-energy turbine jet fuels for three decades, there is presently no commercial process to produce specifically these type of hydrocarbons as a part of the multi-billion dollar jet fuel market. The technologies for hydrogenation of naphthalenes and other aromatics have been available for more than two decades, but commercializing such processes is hampered by the high cost of hydrogen.

Some work on alternative processes for producing decalins by dehydrodimerization (self-condensation) of monocyclic naphthenes can be found in the literature. Unfortunately, there are severe limitations in the usefulness of this previous work for the following reasons: (1) the studies were carried out over 40 to 50 years ago when product analysis was limited and difficult; (2) the experiments were performed mainly for the purpose of understanding the reaction mechanisms of commercial alkylation processes of isobutane with butenes, and, therefore, light olefins ($C_2$–$C_4$) were used as alkylating agents. Consequently, the main products consisted of alkylated monocyclic naphthenes accompanied by minor quantities of decalins as by-products. The alkylcyclohexanes obtained were in the $C_8$-$C_{11}$ range and were not suitable for use as advanced jet fuels; (3) there was insufficient information about how operating variables affect the product distribution.

It has been pointed out previously that alkylsubstituted decalins and other polycyclic naphthenes can be utilized as high quality jet engine fuels. The possibility of producing such hydrocarbons, however, has not attracted in the past the interest of the petroleum refining industry in spite of the fact that some of the potential precursors, e.g., alkylcyclopentanes, are found as abundant oil components.

In summary, there has been a need to extend the limited previous studies toward a well-defined purpose, i.e., the development of new processes for advanced jet fuels. While previous indications existed of self-condensation of methylcyclopentane in the presence of olefins, very little had been explored with respect to monocyclic naphthenes and higher, i.e., $C_5$–$C_8$, olefins which were selected as reactants for the study of acid-catalyzed self-condensation and alkylation reactions directed towards obtaining jet fuel range naphthenic hydrocarbons. Complete analysis of the products, using modern analytical methods, e.g., gas chromatography-mass spectrometry, Fourier transform infrared spectrometry (FTIR), and uC NMR, was performed, allowing for an elevation of the feasibility and the commercial potential of the self-condensation and alkylation reactions studied.

SUMMARY OF THE INVENTION

An efficient method for making jet fuel compositions of high density, low freezing point and high heat of combustion from readily available alkyl cyclopentanes, cyclopentenes, cyclohexanes and cyclohexenes has been invented.

In the instant invention, lower alkyl cyclopentanes, for example, ones which contain an alkyl group having one to three carbon atoms, are reacted with $C_5$–$C_8$ olefins, which may be straight chain, branched chain, or cyclic alkenes, in the presence of sulfuric acid, preferably, at a temperature of about 10° C. to about 50° C. to form a reaction product having a major quantity of decalins, typically in excess of 40% of the total reaction product mixture. Such a reaction product is useful as jet fuel without further processing or with simple distillation to remove volatile components.

In addition to the presence of decalins as a major component in the reaction product, the presence of a significant quantity of $C_{13}$ and higher hydrocarbons further makes the reaction product of the process of this invention especially useful as jet fuel.

The jet fuel compositions of this invention frequently have heats of combustion in excess of 130,000 btu/gal and freezing points below −72° C. Best results are generally achieved through the use of $C_5$ to $C_8$ olefins, especially cyclic compounds such as cyclopentenes and cyclohexenes.

The reactants are generally admixed in sulfuric acid in a ratio of about 0.5:1 to about 20:1 of the alkyl pentane to olefin, with best results being achieved at a reactant ratio of about 2:1 to about 10:1. The olefin concentration in relation to the other reactant is generally maintained low to minimize olefin polymerization. A preferred reaction temperature is from about 0° C. to about 40° C. with especially good results being achieved at temperatures of from about 20° C. to 30° C.

Sulfuric acid, especially concentrated, e.g., 96% concentration or higher, is the preferred catalyst although hydrofluoric acid and phosphoric acid may be used. Phosphoric acid may be useful as a solid catalyst, which has some advantages over liquid acids. Separation of the sulfuric acid catalyst from the reaction products readily occurs, however, by settling and decantation. The nonpolar hydrocarbon reaction products are generally much less dense than the very polar sulfuric acid catalyst and are readily recovered from the top of a settling tank with essentially no acid contamination.

Self-condensation and alkylation catalytic reactions of monocyclic naphthenes, i.e., methylcyclohexane, 1,3-dimethylcylopentane, ethylcyclopentane, methylcyclohexane, and 1,2-dimethylcyclohexane in the presence of higher open-chain olefins ($C_5$–$C_8$): and cycloolefins (cyclohexene and cyclopentene) were investigated in detail. In addition to sulfuric acid, the activity of solid acid catalysts such as phosphoric acid on Kieselguhr, $Ce^{+3}$- and $La^{+3}$-forms of cross-linking montmorillonites (Ce—Al—CLM and La—Al—CLM), a complex of macroreticular acid cation exchange resin and aluminum chloride, rare earth exchanged Y-type zeolite, and silica-alumina were also applied and investigated.

A systematic study of the feed reactivities and reaction selectivities for catalytic alkylation vs. self-condensation was performed as a function of processing variables, i.e., temperature, reactant addition rate, cycloparaffin/olefin molar ratio, cycloparaffin and olefin structure, acid catalyst concentration and strength, was carried out.

The objectives of the study were as follows:

1. To develop selective catalytic alkylation and self-condensation reactions of monocyclic naphthenes for production of higher naphthenic hydrocarbons in the jet and diesel fuel boiling range (b.p., 100°-350° C.);

2. To determine the effect of processing variables on the conversion and selectivity of self-condensation vs. alkylation reactions of monocyclic naphthenes;

3. To develop and evaluate suitable catalytic systems for alkylation and self-condensation reactions of naphthenic hydrocarbons;

4. To determine the physical properties (e.g., density, freezing point, heat of combustion, etc.) of higher naphthenic products and to evaluate the latter as potential major components of advanced jet fuels; and 5. To determine the structure of higher naphthenic products obtained from monocyclic naphthenes and elucidate the mechanism of the alkylation and self-condensation reactions of the latter in the presence of acidic catalysts.

Figure 1:
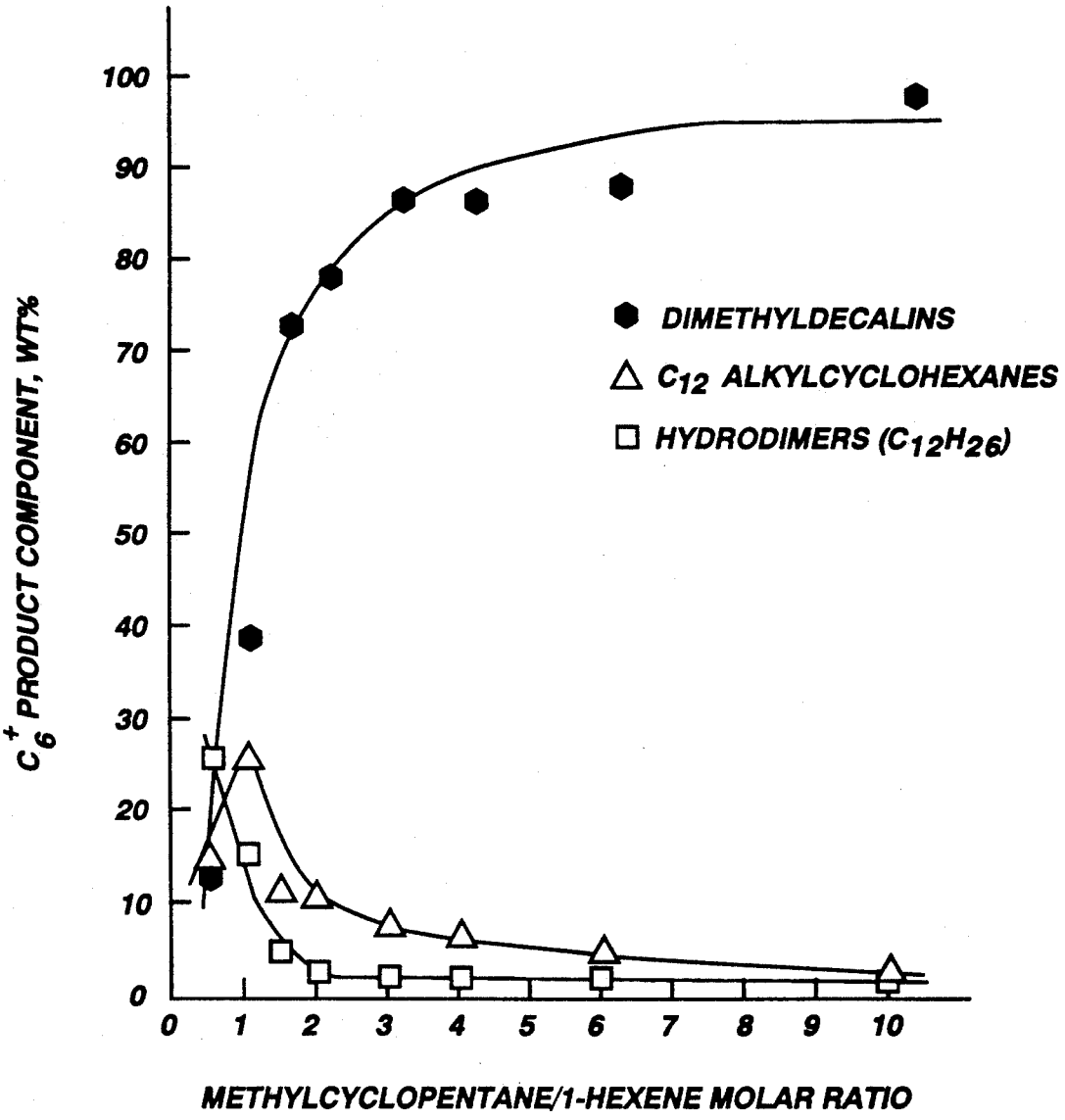
FIG. 1 summarizes the produce distribution of the $C_6+$ products as a function of molar ratio.

TABLE 1 summarizes the change in the composition of products as a function of MCP/1-hexene molar ratio in the range of 0.5 to 9.8 under otherwise nearly identical experimental conditions ($T \approx 22 \pm 2°$ C., addition rate $\approx 0.26$ g/min);

TABLE 2 shows some physical properties of the $C_6+$ fraction of the product obtained from the reaction of methylcyclopentane with 1-hexene as a function of molar ratio.

TABLE 3 summarizes the results obtained;

TABLE 4 summarizes the effect of reaction temperature (in the narrow range of −10° to 50° C.) upon the dehydrodimerization vs alkylation selectivity of the acid-catalyzed reaction of methycyclopentane in the presence of 1-hexene;

TABLE 5 illustrates the effect of reaction temperature on the physical properties of these products;

TABLE 6 summarizes result obtained on the selectivity of dehydrodimerization is alkylation of methylcyclopentane in the presence of normal, branched, and cyclic $C_6$ olefins;

TABLE 7 summarizes results on the selectivity for dehydrodimerization vs alkylation of methylcyclopentane in the presence of normal, branched, and cyclic $C_5$ olefins;

TABLE 8 summarizes results on the selectivity of the dehydrodimerization vs alkylation reactions of MCP as a function of the chain length and type of the olefin;

Table 9 shows the effect of olefin type on the physical properties of $C_6+$ fraction in the products;

Table 10 compares the reactions of methycyclopentane with those of cis-1,3-dimethylcyclopentane and ethylcyclopentane under identical processing conditions;

TABLE 11 summarizes the results obtained;

TABLE 12 summaries the results obtained on the effect of the $H_2SO_4$ catalyst/reactant Volume ratio upon reaction selectivity;

TABLE 13 shows the results obtained;

TABLE 14 summarizes a comparative series of experiments using various solid acid catalyst, i.e., an $AlCl_3$-sulfonic acid complex, a $RE^+$-exchanged Y-type zeolite, a hydroxy-$Al_{13}$-pillared $La^{3+}$-montmorillonite, $SiO_2$-$Al_2O_3$, and $H_3PO_4$ on Kieselguhr support1

TABLE 15 shows the effect of a selected additive, i.e., cetylamine, upon the reaction of methylcyclopentane in the presence of i-hexene.

Results obtained are summarized in Table 16; and

TABLES 17 to 23 give data on molecular peaks and major fragmentation peaks of the products, as obtained by GC-MS analysis with a high-resolution system (VG Micromass 7070 Double Focusing High Resolution Mass Spectrometer with VG Data System 200).

DETAILED DESCRIPTION OF THE ILLUSTRATED EMBODIMENT

Alkylation and Dehydrodimerization Reactions of Alkylcyclopentanes

In order to develop a novel processing concept for producing high quality jet fuels such as substituted decalins, the catalytic alkylation and self-condensation reactions of alkylcyclopentanes in the presence of olefins was systematically explored. Methylcyclopentane, and to a lesser extent, 1,3-dimethylcyclopentane, and ethylcyclopentane were used as model monocyclic naphthenic feeds. Olefinic reagents included $C_5$–$C_8$ olefins, and in particular 1-hexene.

Most of the alkylation and self-condensation reactions were carried out in a semibatch system in which the hydrocarbon phase was contacted with a sulfuric acid catalyst. In some experimental runs, however, a solid acid catalyst Was used.

Liquid products obtained were identified by a combination of gas chromatography, mass spectrometry, FTIR, and NMR analysis. Quantitative analysis was performed by gas chromatography.

It is well known that alkylate quality in commercial $H_2SO_4$ alkylation units for alkylating isobutane is a function of the isobutane concentration, olefin space velocity, acid fraction in the emulsion, and the degree of agitation (impeller speed). The evidence that higher octane rating alkylates are produced at higher agitation speed suggests that mass transfer effects are important. In prior work, Kramer determined that the solubility of methylcyclopentane in 96% $H_2SO_4$ at 25° C. is about 60 ppm and concluded that the agitation speed applied should be at least 1000 rpm to maximize the hydride transfer reactions.

In the present work, several series of experiments at a constant stirring rate (1300 rpm) were performed in order to investigate the effects of processing variables, i.e., temperature, alkylcyclopentane/olefin molar ratio, reactants addition rate, catalyst concentration, and acid strength, upon the alkylation and self-condensation reactions of methylcyclopentane (MCp). The effect of the substituent in the alkylcyclopentane feed was also examined by a comparison of the reactions of methylcyclopentane (MCP), 1,3-dimethylcyclopentane (1,3-DMCD), and ethylcyclopentane (ECP).

Effect of Alkylcyclopentane/Olefin Molar Ratio

Table 1 summarizes the change in the composition of products as a function of MCP/1-hexene molar ratio in the range of 0.5 to 9.8 under otherwise nearly identical experimental conditions ($T \approx 22 \pm 2°$ C., addition rate¢0.26 g/min). Under these conditions, three main types of products are formed, i.e., (1) dimethyldecalins (DMD), viz. self-condensation products of MCP; (2) $C_{12}$ alkylcyclohexanes (plus lower alkylcyclohexanes); and (3) $C_4$–$C_6$ hydrogen transfer products, predominantly branched hexanes. In addition, small amounts of hexene hydrodimers ($C_{12}H_{26}$) and $Cu_{12}$ + products (mainly $C_{18}H_{34}$ and $C_{18}H_{32}$) are observed.

Dimethyldecalins are formed by the condensation of two moles of methylcyclopentane with the liberation of one mole of hydrogen. Hexenes and hexene dimers play the role of hydrogen acceptors to form branched hexanes and hydrodimers.

As seen from Table 1, an increase in MCP/1-hexene molar ratio results in a decrease in the MCP conversion (from 91.6% to 27.5%). However, the selectivity of the MCP conversion to dimethyldecalins vs $C_{12}$ alkylcyclohexanes markedly increases (from 12.5% at a MCP/1-hexene molar ratio of 0.5 to 98.6% at a ratio of 9.8). Self-condensation (dehydrodimerization) of methylcyclopentane to form dimethyldecalins and attendant hydrogen transfer to form branched hexanes become predominant reactions at MCP/1-hexene molar ratios of 1.5 to 9.8. At a ratio of 9.8, about 99% of the 1-hexene is converted to methylpentanes and a selectivity of 98.6 wt% for formation of dimethyldecalins is observed. The formation of hydrodimers ($C_{12}H_{26}$) decreases as the molar ratio increases, while the yield of $C_{12}$ alkylcyclohexanes first increases, and reaches a maximum at a ratio of 1.0, but then sharply decreases as the molar ratio is further increased. Likewise, the formulation of $C_7$–$C_{11}$ hydrocarbons (mostly $C_7$–$C_{11}$ alkylcyclohexanes) decreases sharply as the molar ratio increases. FIG. 1 summarizes the produce distribution of the $C_6$+ products as a function of molar ratio.

Table 2 shows some physical properties of the $C_6$+ fraction of the product obtained from the reaction of methylcyclopentane with 1-hexene as a function of molar ratio. All the $C_6$+ products show excellent physical properties. For a MCP/1-hexene molar ratio of 2 or greater, the properties of $C_6$+ products exceed the specifications of JP-8X and nearly meet the JP-11 specifications.

Effect of Reactant's Addition Rate

Figure 2:
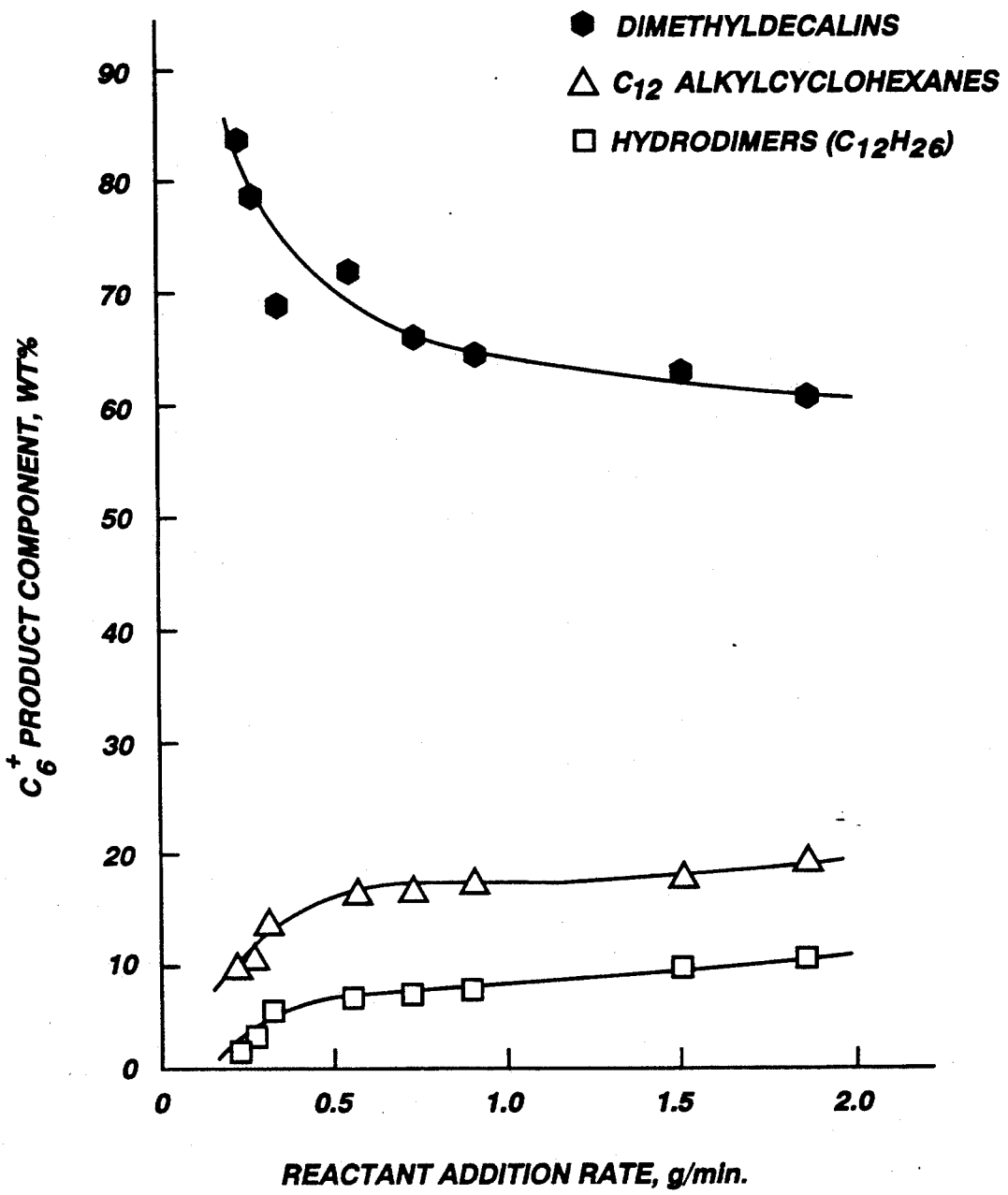
FIG. 2 shows the distribution of the $C_6+$ products as a function of reactants addition rate.

The effect of the addition rate of MCP -1-hexene reactant mixture to the liquid catalyst ($H_2SO_4$) was also studied. The range of addition rates examined was 0.23 to 1.86 g/min. Results obtained are summarized in Table 3. As seen, increase in reactants addition rate results in a slight decrease in MCP conversion (from 73.8% to 65.0%) and in a moderate decrease in the selectivity of MCP conversion to dimethyldecalins vs $C_{12}$ alkylcyclohexanes (from 83.9% to 0.26 g/min to 60.6% at 1.86 g/min). Further, the yield of hydrodimers ($C_{12}H_{26}$) increases to some extend with increase in the addition rate. The distribution of the $C_6$+ products as a function of reactants addition rate is shown also in FIG. 2. $C_7$–$C_{11}$ hydrocarbons which are minor products increase but only slightly with increased addition rate.

Effect of Temperature

Figure 3:
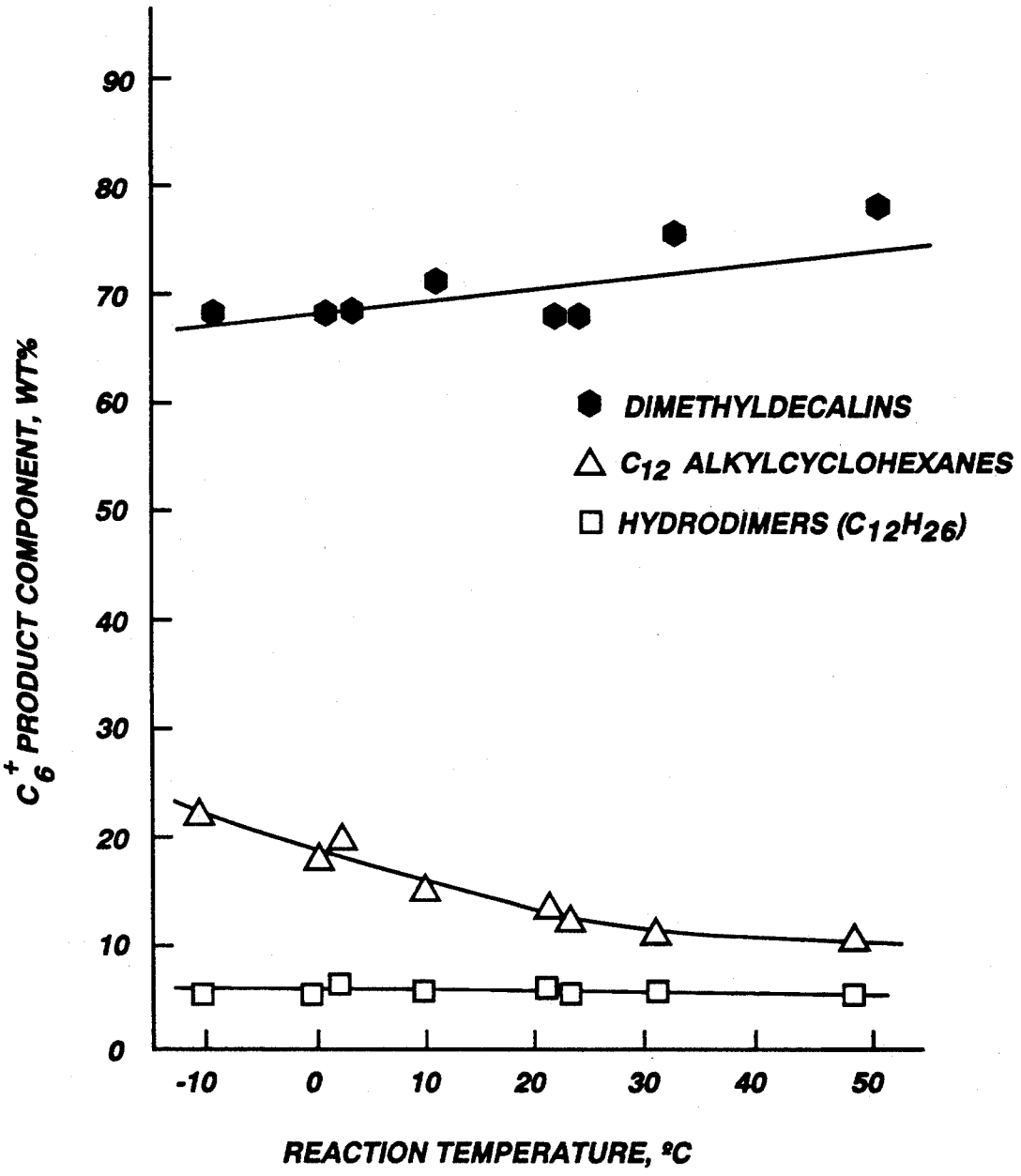
FIG. 3 depicts the distribution of the $C_6+$ products as a function of temperature.

Table 4 summarizes the effect of reaction temperature (in the narrow range of −10° to 50° C.) upon the dehydrodimerization vs alkylation selectivity of the acid-catalyzed reaction of methycyclopentane in the presence of 1-hexene. As seen, the total MCP conversion observed under the experimental conditions remains essentially constant (70–76 wt%) at temperatures between −10° to 23° C. and then drops to a slight extent between 30°–50° C. The selectivity for dehydrodimerization was also unchanged between −10° to 23° C., but increased as the temperature was raised to 31°–50° C. The observed decrease in the yield of $C_{12}$ alkylcyclohexanes with increase in temperature is consistent with the previously observed decrease in the rate of alkylation of isobutane with olefins at higher temperatures, e.g., >45 ° C. The distribution of the C. products as a function of temperature is depicted in FIG. 3. Table 5 illustrates the effect of reaction temperature on the physical properties of these products. All the $C_6$+products show excellent physical properties, i.e., high density, high heats of combustion, and very low freezing points. The products obtained at reaction temperatures between 23°–31° C. show the best properties, suggesting that water could be used as a coolant for the reaction. In such a case, the refrigeration cost will be much lower than that in a commercial $H_2SO_4$ alkylation unit which usually operates in the range of 2°–13° C.

Effects of Olefinic Reactant Structure and of Alkylcyclopentane Type

Information on the reactivity of methylcyclopentane in the presence of structurally distinct $C_5$–$C_8$ normal and branched olefins, as well as cyclic olefins, is of importance in determining the feasibility of a process for production of naphthene-rich jet fuels. Table 6 summarizes result obtained on the selectivity of dehydrodimerization vs alkylation of methylcyclopentane in the presence of normal, branched, and cyclic $C_6$ olefins. Comparison of the reactants in the presence of $C_6$ open-chain olefins (runs no. 11, 24, 25, 26, and 27) indicates that in the presence of the normal isomer (1-hexene) the MCP conversion is somewhat higher (74.1%) than that obtained with the singly branched $C_6H_{12}$ isomer,4-methyl-1-pentene (65.4%). Higher selectivity for MCP conversion to DMD vs $C_{12}$ alkylcyclohexanes is observed (71.9%–73.4%) in the presence of doubly branched $C_6$ olefins (i.e., 2,3-dimethyl-1-butene; 2.3-dimethyl-2-butene; 3,3-dimethyl-i-butene) which are apparently excellent hydrogen acceptors, and due to steric reasons caused relatively high DMD vs ring alkylation selectivity. Dimethyldecalins and some tricyclics ($C_{18}H_{32}$) are the predominant products in the run with cyclohexene as reactant. The yield of these products are 92.6 wt% in the $C_6$+ fraction, respectively.

Table 7 summarizes results on the selectivity for dehydrodimerization vs alkylation of methylcyclopentane in the presence of normal, branched, and cyclic $C_5$ olefins. As seen, the reaction selectivity trends of methylcyclopentane are similar to those in the presence of $C_6$ olefins. Thus, conversion is somewhat higher with the normal olefins (1-pentene and 2-pentene) a compared with that in the presence of a singly branched isomer (2-methyl-i-butene). Further, MCP conversion is significantly lower, but the selectivity for dimethyldecalin (plus monomethyldecalin) formation is markedly higher in the presence of cyclopentene (run 31)

indicating a high reactivity of cyclopentene both as a hydrogen acceptor and alkylating agent. The total yield of hydrogen transfer products obtained with cyclopentene is lower than that obtained with open chain $C_5$ olefins. As above indicated, methyldecalins and tricyclic naphthenes ($C_{16}H_{28}$) are major products when cyclopentene is used as olefinic reactant. The yields of such compounds are 78.6 wt% and 16.6 wt% of the $C_6$+ product, respectively.

Table 8 summarizes results on the selectivity of the dehydrodimerization vs alkylation reactions of MCP as a function of the chain length and type of the olefin. As seen, for cis-2-butene the DMD selectivity is rather low (25%), whereas the alkylation selectivity, leading to $C_{10}$–$C_{14}$ polyaklylsubstituted cyclohexanes, is very high (~74%). However, there is a sharp increase in DMD selectivity with increase in the chain length of the olefin from $C_4$ to $C_5$ and $C_6$, as reflected by the selectivities with 1-$C_5H_{10}$ (64.6%) and 1-$C_6H_{12}$ (68.9%) as olefinic reactants. The selectivity with the normal $C_7$ and $C_8$ olefins (1-heptene and 1-octene) is slightly higher (72.3% and 71.4%, respectively) than that with 1-hexene, but it decreases to some extent with the branched isomer, 2,4,4-trimethyl-1-pentene (55.0%).

Table 9 shows the effect of olefin type on the physical properties of $C_6$+ fraction in the products. The products obtained with cyclohexene and cyclopentene as olefinic reactants exhibit excellent physical properties and can be used as potential components of advanced jet fuels, e.g., JP-11.

Table 10 compares the reactions of methycyclopentane with those of cis-1,3-dimethylcyclopentane and ethylcyclopentane under identical processing conditions (see footnote a). As seen (experiment 36), the overall conversion and product distribution from 1,3-dimethylcyclopentane is similar to that of methylcyclopentane, indicating that di- or polymethylsubstituted cyclopentanes present as major components in naphthas can be easily transformed into bicyclic naphthenes under the processing conditions. The bicyclic products from cis-1,3-DMCP consist mostly of tetramethyldecalins as compared with the formation of dimethyldecalins from MCP.

The reaction of ethylcyclopentane, on the other hand, is quite different as it produces $C_{13}$ alkylcyclohexanes in much higher yield than bicyclic naphthenes (experiment 36-1). The difference can be explained by the fast skeletal isomerization of ECP to methylcyclohexane (MCH) in the presence of sulfuric acid, MCH undergoes faster ring alkylation to polyalkylated cyclohexanes than self-condensation to bicyclic naphthenes. It was indeed found in experiment 36-1 that about 65% of the "unreacted" ethylcyclopentane feed consists of methylcyclohexane.

Effect of Acid Concentration of Acid/Reactant Ratio

Figure 4:
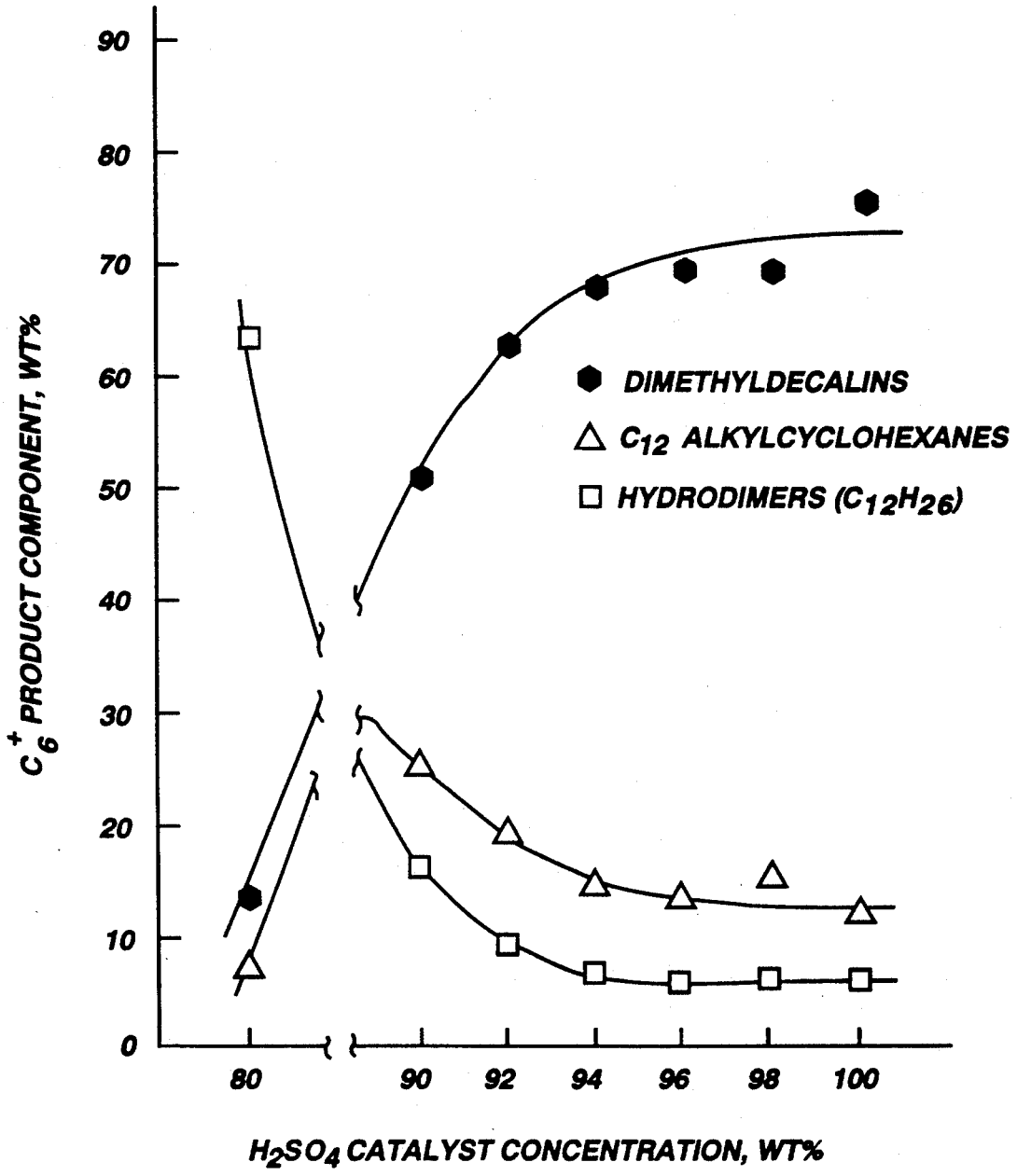
FIG. 4 summarizes the above trends in product distribution of $C_6+$ fraction as a function of the $H_2SO_4$ concentration.

In commercial sulfuric acid alkylation units, the acid concentration is usually kept at least a level of 88 to 90 wt% to eliminate side reactions. In the present work, a series of experiments were performed to examine the effect of acid concentration, in the range of 80 to 100 wt%, upon the catalytic reactions of methylcyclopentane with 1-hexene. Results obtained are summarized in Table 11. The acid concentration indicated is that of the initial catalyst introduced in the reactor. As seen, the total MCP conversion is in a narrow range (68.3–74.1%) for acid concentrations ≧94%. The conversion is in a narrow range (68.3–74.1%) for acid concentrations from 100% to 96%, but then gradually decreases by further decrease in concentration from 96% to 90%. Decrease in acid concentration to 80% causes a sharp decrease in MCP conversion. It was also found (Table 11) that the acid concentration affects the selectivity for DMD vs. alkylcyclohexane formation, i.e., the selectivity gradually decreases in acid catalyst concentration (from 74.8% at a concentration of 100% to 62.2% at a concentration of 92%), and then sharply drops (to 13.4%) at a concentration of 80%. The results obtained show that self-condensation of methycyclopentane is the principal reaction when the $H_2SO_4$ catalyst concentration is kept at a level ≧94 wt%. FIG. 4 summarizes the above trends in product distribution of $C_6$+ fraction as a function of the $H_2SO_4$ concentration. At a level of 80%, dimerization of the olefin (1-hexene) becomes the main reaction.

Figure 5:
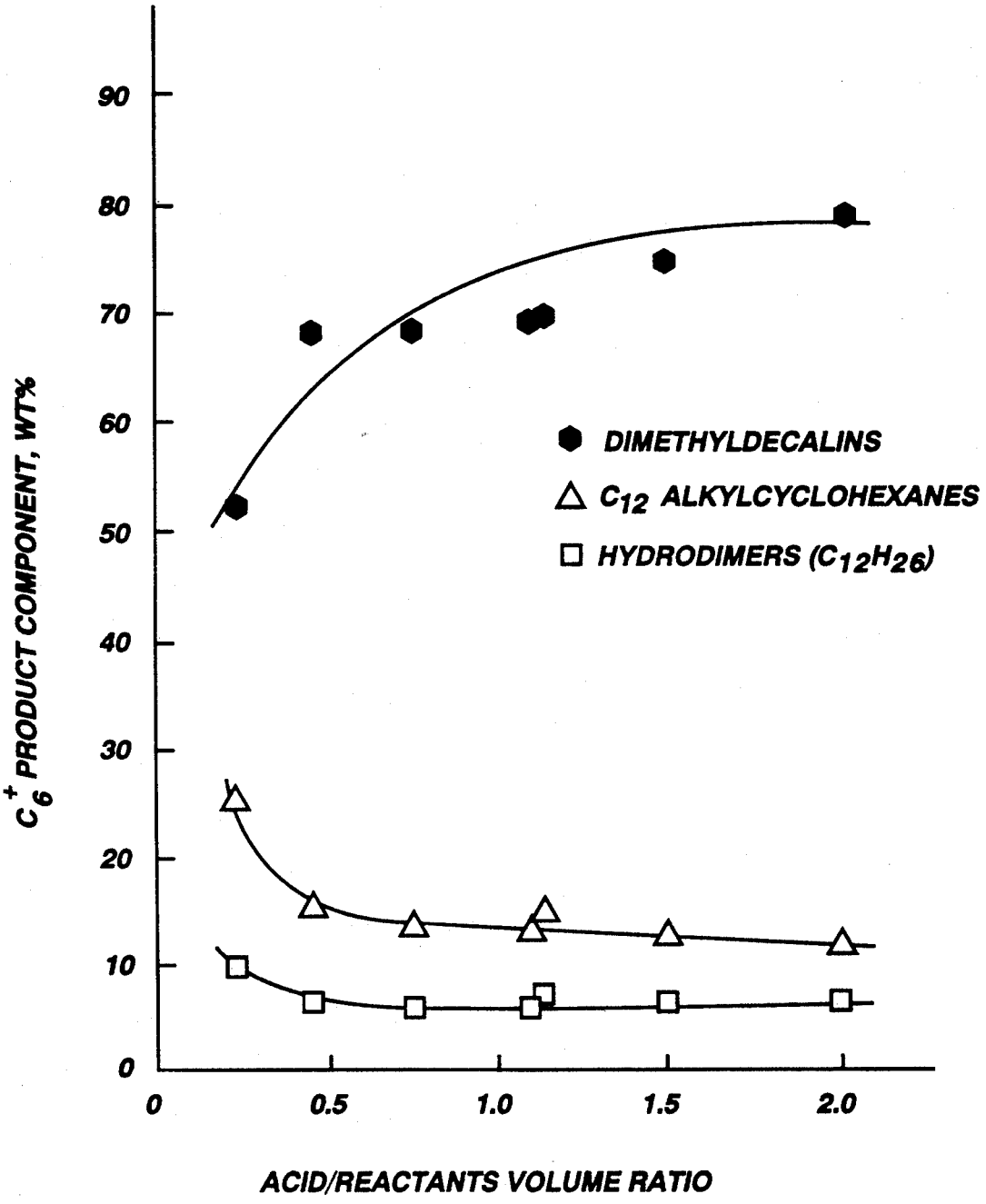
FIG. 5 shows the product distribution of the $C_6+$ fraction as a function of catalyst/reactant volume ratio.

Commercial alkylation units are usually set with 40–60 vol% acid in the reaction emulsion. In the present work, a series of additional experiments were performed to examine the effect of acid/reactant volume ratio upon the direction of catalytic reactions of methycyclopentane in the presence of 1-hexene. Table 12 summaries the results obtained on the effect of the $H_2SO_4$ catalyst/reactant volume ratio upon reaction selectivity. As seen, the MCP conversion is approximately constant (~72–75%) for catalyst/reactant volume ratios in the range of 0.7 to 1.5, and it is only slightly lower (~65–67%) at lower ratios (0.2–0.5). On the other hand, the selectivity for dehydrodimerization vs. alkylation increases to some extent (from 51.7% to 77.6%) with increase in the catalyst/reactant ratio. The significance of run 43 is that the reaction can be satisfactorily performed even at relatively low catalyst/reactant ratios (about 30 vol% acid in the emulsion) without any major decrease in conversion and selectivity. FIG. 5 shows the product distribution of the $C_6$+ fraction as a function of catalyst/reactant volume ratio.

Effect of Acid Catalyst Type

Problems involved in commercial alkylation processes with sulfuric acid and HF as catalyst include the handling of highly corrosive materials and the necessity of treatment of the alkylates aimed at removal of traces of acids and sulfate esters. A solid acid catalyst could eliminate many of these problems. Although most of the present work was performed with sulfuric acid as catalyst, several solid acids were also examined as potential catalysts. Several runs with MCP and 1-hexene as reactants were performed in a semi-batch reactor at temperatures in the range of 26°–15° C., using an $AlCl_3$-sulfonic acid resin complex as catalyst. Table 13 shows the results obtained. As seen, $C_{12}$ alkylcyclohexanes (mostly methylpentylcyclohexanes) are the principal products at temperatures of 26°–58° C. (experiments 47–49), indicating that at such low reaction temperatures the extent of DMD formation with this catalyst is rather negligible. The predominant reaction involves ring alkylation of the monocyclic naphthene reactant (MCP). The direction of the reaction, however, did change in a dramatic manner in another experiment (no. 50) which was performed at a higher temperature (115° C.) in a 150 $cm^3$ autoclave reactor. In this run, dimethyldecalins (and some higher boiling products) were formed in markedly higher yield as compared with that of $C_{12}$ alkylcyclohexanes. This observation is of major importance since it indicates that the self-condensation and alkylation of alkylcyclopentanes can be eventually performed at higher temperature in a continuous flow reactor using a suitable solid acid catalyst.

Table 14 summarizes a comparative series of experiments using various solid acid catalyst, i.e., an $AlCl_3$-sulfonic acid complex, a $RE^{3+}$-exchanged Y-type zeolite, a hydroxy-$Al_{13}$-pillared $La^{3+}$-montmorillonite, $SiO_2$-$Al_2O_3$, and $H_3PO_4$ on Kieselguhr support. A 150 ml autoclave was employed in these runs and the reaction temperature was in the narrow range of 190°-225° C. (except in run 50, where a temperature of 115° C. was used due to the low thermal stability of the resin catalyst). As seen, the reactions in the presence of all catalysts, with the exception of the $AlCl_3$-sulfonic acid resin, yield mostly $C_{12}$ alkylcyclohexanes under the experimental conditions indicated. In the presence of such solid catalysts, polymerization of 1-hexene also occurred to some extent (12.8-25.2%), as a competing reaction.

Effect of Other Processing Variables

Introducing a suitable additive into the alkylation reactor has been applied in refining industries to reduce sulfuric acid consumption. Evidence of a slower rate of degradation of the acid concentration by using cetylamine and oetyltrimethylammonium bromide was provided by Kramer with respect to commercial isobutane alkylation. Table 15 shows the effect of a selected additive, i.e., cetylamine, upon the reaction of methylcyclopentane in the presence of 1-hexene. As seen, the additive has essentially no effect upon the MCP conversion, whereas the selectivity for DMD vs. ring alkylation is apparently slightly increased in the presence of the additive. Furthermore, the yield of tricyclic hydrocarbons ($C_{18}H_{32}$) decreases to some extent. The weight gained in the acid phase is slightly reduced. This indicates that the formation of conjunct polymers and the acid consumption are reduced in the presence of the cetylamine. Some amounts of alkyl esters (a viscous yellowish liquid) are obtained when cetylamine was added to the $H_2SO_4$ catalyst.

Addition of minor amounts of promoters, e.g., trifluoromethanesulfuric acid ($CF_3SO_3H$) or fluorosulfonic acid to the alkylation catalyst (i.e., HF or $H_2SO_4$) has been previously found to increase the yield and the octane ratings of the alkylate.

In the present work several runs with $CF_3SO_3$ H as promoter were performed using again MCP and i-hexene as reactants. Results obtained are summarized in Table 16. As seen, $CF_3SO_3H$ has no promoting effect upon the total MCP conversion, although it may be causing a minor increase in DMD selectivity. It should be noted that the water content in 96% $H_2SO_4$ used in our runs may be too high to be tolerated by the promotor, since trifluoromethane sulfonic acid reacts rapidly with water to form a stable monohydrate.

EXAMPLE

Figure 6:
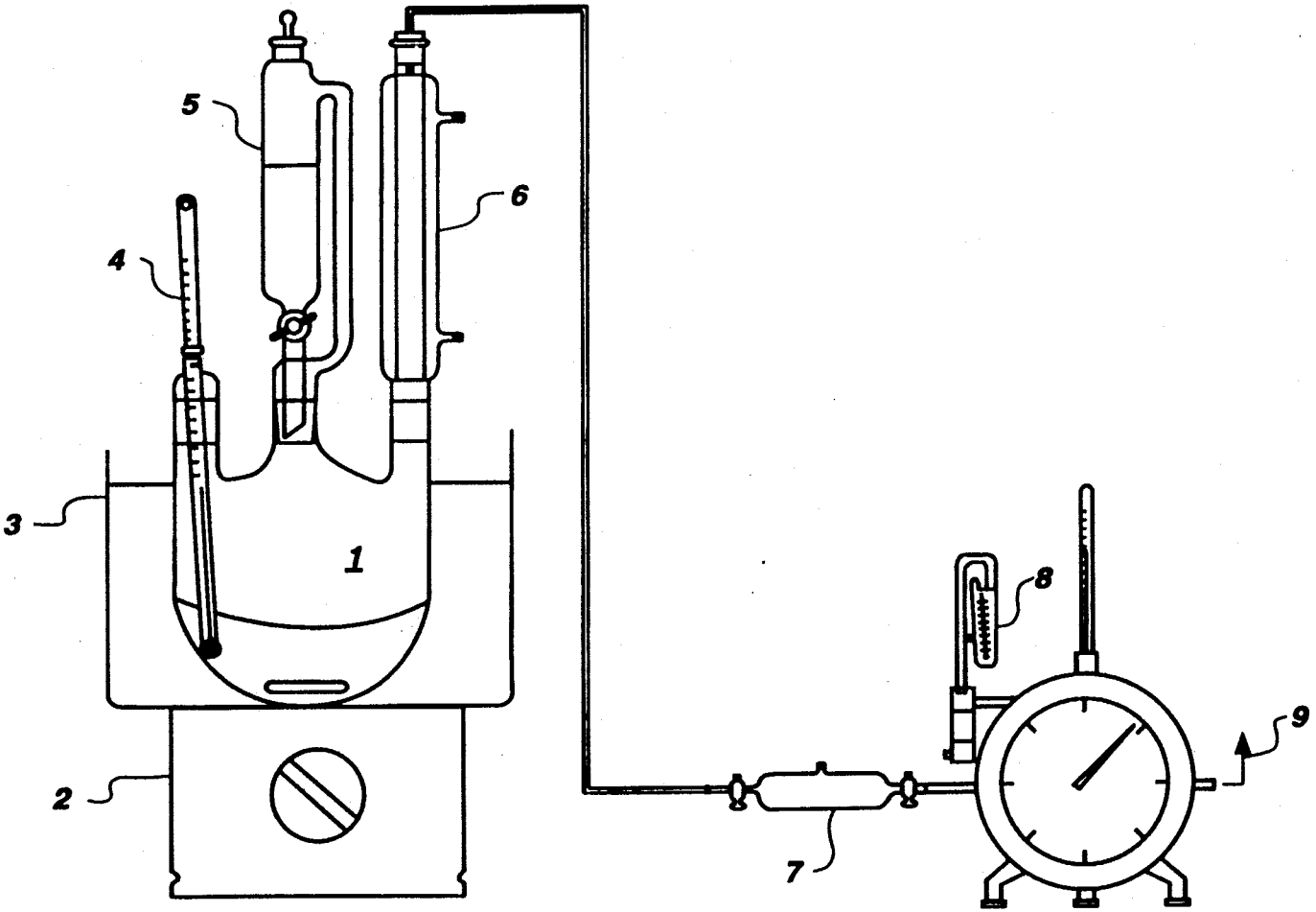
FIG. 6 is a schematic illustration of a liquid phase alkylation apparatus.

Two reactor systems for the study of alkylation and dehydrodimerization reactions were constructed and applied; i.e.:

1. A liquid-phase semibatch reactor, consisting of a three-neck flask 1, equipped with a a magnetic stirrer 2, a reflux condenser 6, a dropping funnel 5, for introducing the reactants, and a water bath (FIG. 6); and
2. A high pressure magnedash autoclave of 150 $cm^3$ capacity.

In most experiments with the liquid-phase semibatch reactor, a liquid acid (concentrated $H_2SO_4$) was placed in the three-necked flask of 1000 ml capacity, and a mixture of the starting materials (naphthene plus olefin) were added dropwise. Contact between the acid and the hydrocarbon reactants was ensured by vigorous mixing. Following is a description of a typical experimental run.

One hundred sixty g of 96% $H_2SO_4$ was placed in the reactor, which was controlled at the desired temperature (e.g., 25° C.), and a mixture consisting of 33.5 g of methylcyclopentane and 17.0 g of 1-hexene was added dropwise to the vigorously stirred acid catalyst at a rate of about 1.2 g/min (total addition time, ~42 min). After completing the addition of the reactants, the mixture was stirred for an additional period of 30 min and then left to stand for one hour. The acid layer was then separated from the upper hydrocarbon layer with a separatory funnel, and the hydrocarbon product was sequentially washed with deionized water, aqueous 5% NaOH, and finally again with deionized water. The washed product was dried over anhydrous $MgSO_4$ overnight, filtered, and analyzed by gas chromatography and other methods (see below).

In experiments performed in the autoclave reactor, a solid acid catalyst (e.g. Mobil Durabead #8, rare-earth exchanged Y-zeolite, $SiO_2$-$Al_2O_3$, or hydroxy-Al pillared $La^{+3}$ montmorillonite) was first calcined at a temperature of 530° C. for 22 hours. In the case of solid silico-phosphoric acid ($H_3PO_4$ on Kieselguhr) as catalyst, the preliminary heating was performed at 220° for 2 hours.

In a typical run with solid catalyst, about 25 g of the reactant mixture, consisting of methylcyclopentane/1-hexene in a molar ratio of 2.0, was charged to the autoclave and 6 g of catalyst was introduced in the Magnedash catalyst cage. The autoclave was pressurized with nitrogen 5 to 1500 psig and heated without stirring to the desired temperature, at which time the stirring was started. The reaction was continued for a period of 2-4 hours. At the end the reactor was cooled down to room temperature and the product was removed, filtered, and subjected to analysis.

Methyl pentane and cyclopentene in a molar ratio of 2 to 1 were introduced together into a vessel containing 96% sulfuric acid The reaction mixture was agitated for a period of time (about 3 hours) at a temperature of about 25°.

The sulfuric acid/reaction product mixture was permitted to settle. The reaction products (hydrocarbons) were recovered from the top of the vessel.

The reaction product was analyzed and found to have the following content: 3.4 wt.% $C_4$-$C_5$ : alkanes, 7.0 wt.% cyclopentane, 0.7 wt.% $C_7$-$C_{10}$ hydrocarbons, 70.4 wt.% methyldecalins, 3.6 wt.% dimethyldecalins, and 14.9 wt.% $C_{12}$+ hydrocarbons (mostly $C_{16}H_{28}$; tricyclic naphthenes).

The inventive process described herein is preferably operated to provide a specification for jet fuel which contains a minimum content of about 35% and preferably at about 40% decalins and at least 4% and preferably about 10% alkylated single ring naphthenes and higher hydrocarbons with minimum distillation or refining to remove excess reactants and volatiles.

Conducting the process in the preferred manner, as described hereinabove, and as may be readily discerned from the experimental data set forth in the various tables and graphs readily produce a reaction product having the preferred quantity of decalins. Jet fuels have specifications which enhance boiling points, freezing points and the like.

TABLE 1

Effect of Methylcyclopentane (MCP)/1-Hexene Molar Ratio upon Dehydrodimerization (DHD) vs. Ring Alkylation Selectivity[a]

| Experiment no. | 1 | 2 | 3 | 4 | 5 | 6 | 7 | 8 |
|---|---|---|---|---|---|---|---|---|
| Reactant charged, g | | | | | | | | |
| MCP | 20 | 30 | 41 | 37 | 49.5 | 50 | 46.3 | 49 |
| 1-Hexene | 40.5 | 30 | 27.5 | 18.5 | 16.5 | 12.5 | 7.7 | 5 |
| Catalyst, g 96% $H_2SO_4$ | 166.5 | 159.5 | 175.5 | 167.5 | 182 | 178.4 | 162.4 | 146.5 |
| MCP/1-Hexene (molar ratio) | 0.5 | 1.0 | 1.5 | 2.0 | 3.0 | 4.0 | 6.0 | 9.8 |
| Product recovered, g | | | | | | | | |
| Hydrocarbons | 46 | 47.5 | 60 | 48.5 | 62 | 60 | 51.8 | 53.5 |
| Acid layer | 178.5 | 167.5 | 179.5 | 169.5 | 182 | 178.4 | 161.6 | 144 |
| Losses | 2.0 | 4.5 | 4.5 | 5.0 | 4.0 | 2.5 | 2.8 | 3.0 |
| MCP conversion, wt % | 91.6 | 89.3 | 80.6 | 73.1 | 60.5 | 50.2 | 40.3 | 27.5 |
| Product distribution, wt % | | | | | | | | |
| $C_4$-$C_6$ Hydrocarbons[b] | 26.6 | 36.0 | 37.5 | 35.6 | 34.3 | 34.5 | 36.1 | 43.0 |
| $C_7$-$C_{11}$ Hydrocarbons[c] | 32.7 | 10.2 | 2.6 | 1.5 | 0.5 | 0.4 | 0.4 | 0.2 |
| Hydrodimers ($C_{12}H_{26}$)[d] | 18.8 | 9.7 | 2.7 | 1.5 | 0.4 | 1.2 | 0.4 | 0.1 |
| $C_{12}$ Alkylcyclohexanes | 10.6 | 16.5 | 7.1 | 6.5 | 4.7 | 4.8 | 3.4 | 0.3 |
| Dimethyldecalins (DMD) | 9.2 | 24.9 | 46.1 | 50.7 | 57.4 | 55.4 | 56.7 | 56.2 |

TABLE 1-continued

Effect of Methylcyclopentane (MCP)/1-Hexene Molar Ratio upon Dehydrodimerization (DHD) vs. Ring Alkylation Selectivity[a]

| | | | | | | | | |
|---|---|---|---|---|---|---|---|---|
| Higher ($C_{12}^+$) | 2.1 | 2.7 | 4.0 | 4.2 | 2.6 | 3.6 | 3.1 | 0.2 |
| Selectivity for DMD, wt %[e] | 12.5 | 38.9 | 73.8 | 78.8 | 87.3 | 84.6 | 88.7 | 98.6 |

[a]Reaction conditions: T = 22 ± 2° C.; reactants addition rate, 0.26 g/min (0.35 g/min in experiment no. 5).
[b]Hydrogen transfer products (predominantly branched hexanes).
[c]Mostly alkylcyclohexanes.
[d]Branched dodecanes.
[e]Selectivity of MCP conversion into dimethyldecalins (excluding the $C_4$-$C_6$ hydrogen transfer products).

TABLE 2

Effect of the MCP/1-Hexene Molar Ratio upon Some Physical Properties of the $C_6^+$ Product[a]

| Experiment no. | 2 | 4 | 6 |
|---|---|---|---|
| MCP/1-Hexene (molar ratio) | 1.0 | 2.0 | 4.0 |
| Density (g/cm 15.6° C.) | 0.8270 | 0.8618 | 0.8679 |
| Freeezing point, °C. | <−72 | <−72 | <−72 |
| Hydrogen content, wt % | 13.94 | 13.55 | 13.43 |
| Net heat of combustion | | | |
| Btu/lb | 18,546 | 18,384 | 18,362 |
| Btu/gal | 128,000 | 132,200 | 133,000 |

[a]Total product higher than $C_6$ hydrocarbons.

TABLE 3

Effect of Reactants Addition Rate upon the Dehydrodimerization (DHD) vs. Ring Alkylation Selectivity in the Reaction of Methylcyclopentane (MCP)[a]

| Experiment no. | 9 | 4 | 10 | 11 | 12 | 13 | 14 | 15 | 16 |
|---|---|---|---|---|---|---|---|---|---|
| Reactant added, g | | | | | | | | | |
| MCP | 80 | 37 | 36 | 36 | 37 | 36 | 40 | 36 | 36 |
| 1-Hexene | 40 | 18.5 | 18 | 18 | 18.5 | 18 | 20 | 18 | 18 |
| Catalyst, g 96% $H_2SO_4$ | 329 | 167.5 | 151.5 | 157.4 | 160 | 157.4 | 151.4 | 155 | 157.5 |
| Reactant addition rate, g/min | 0.23 | 0.26 | 0.31 | 0.32 | 0.56 | 0.71 | 0.90 | 1.50 | 1.86 |
| Product recovered, g | | | | | | | | | |
| Hydrocarbons | 112 | 48.5 | 49.7 | 49.6 | 50.5 | 49.6 | 54.1 | 49.0 | 49.1 |
| Acid layer | 334 | 169.5 | 154.2 | 159.6 | 162 | 160.5 | 155.4 | 158.7 | 161.5 |
| Losses | 3.0 | 5.0 | 1.6 | 2.2 | 3.0 | 1.3 | 1.9 | 1.3 | 0.9 |
| MCP conversion, wt % | 73.8 | 73.1 | 74.6 | 74.1 | 71.6 | 70.6 | 69.6 | 67.5 | 65.0 |
| Product distribution, wt % | | | | | | | | | |
| $C_4$-$C_6$ Hydrocarbons[b] | 34.2 | 35.6 | 31.1 | 30.9 | 35.2 | 31.8 | 31.6 | 32.0 | 32.2 |
| $C_7$-$C_{11}$ Hydrocarbons[c] | 1.2 | 1.5 | 1.5 | 1.5 | 1.7 | 1.8 | 1.8 | 2.1 | 2.0 |
| Hydrodimers ($C_{12}H_{26}$)[d] | 0.8 | 1.5 | 3.4 | 3.8 | 4.0 | 4.2 | 4.5 | 5.2 | 5.7 |
| $C_{12}$ Alkylcyclohexanes | 6.0 | 6.5 | 8.3 | 9.1 | 9.4 | 9.6 | 10.0 | 10.9 | 12.1 |
| Dimethyldecalins (DMD) | 55.0 | 50.7 | 47.0 | 47.6 | 46.9 | 45.4 | 44.9 | 42.4 | 41.1 |
| Higher ($C_{12}^+$) | 2.6 | 4.2 | 8.6 | 7.1 | 2.7 | 7.2 | 7.2 | 7.4 | 6.9 |
| Selectivity for DMD, wt %[e] | 83.9 | 78.8 | 68.2 | 68.9 | 72.4 | 66.6 | 65.6 | 62.4 | 60.9 |

[a]Reaction conditions: MCP/1-Hexene = 2.0 (molar), T = 22 ± 2° C.
[b]Hydrogen transfer products (predominantly branched hexanes).
[c]Mostly alkylcyclohexanes.
[d]Branched dodecanes.
[e]Selectivity of MCP conversion into dimethyldecalins (excluding the $C_4$-$C_6$ hydrogen transfer products).

TABLE 4

Effect of Reaction Temperature upon the Dehydrodimerization (DHD) vs. Ring Alkylation Selectivity in the Reaction of Methylcyclopentane (MCP)[a]

| Experiment no. | 17 | 18 | 19 | 20 | 11 | 12 | 21 | 22 |
|---|---|---|---|---|---|---|---|---|
| Reactant added, g | | | | | | | | |
| MCP | 36 | 36 | 36 | 36 | 36 | 36 | 37 | 36 |
| 1-Hexene | 18 | 18 | 18 | 18 | 18 | 18 | 18.5 | 18 |
| Catalyst, g 96% $H_2SO_4$ | 163.3 | 162.6 | 161 | 157.6 | 157.4 | 151.5 | 166 | 160.4 |
| Reaction temperature, °C. | −10 | 0 | 2 | 9 | 21 | 23 | 31 | 50 |
| Product recovered, g | | | | | | | | |

TABLE 4-continued

Effect of Reaction Temperature upon the Dehydrodimerization (DHD) vs. Ring Alkylation Selectivity in the Reaction of Methylcyclopentane (MCP)[a]

| | | | | | | | | |
|---|---|---|---|---|---|---|---|---|
| Hydrocarbons | 49 | 49.9 | 50 | 49.7 | 49.5 | 49.7 | 48.5 | 44.1 |
| Acid layer | 166 | 164.8 | 166.5 | 160.4 | 159.5 | 154.2 | 168 | 168.4 |
| Losses | 2.3 | 1.9 | 1.0 | 1.6 | 2.3 | 1.6 | 5.0 | 0.9 |
| MCP conversion, wt % | 76.0 | 69.8 | 70.0 | 70.0 | 74.1 | 74.6 | 65.1 | 61.1 |
| Product distribution, wt % | | | | | | | | |
| $C_4$–$C_6$ Hydrocarbons[b] | 26.3 | 32.5 | 30.4 | 32.8 | 30.9 | 31.1 | 40.3 | 51.4 |
| $C_7$–$C_{11}$ Hydrocarbons[c] | 0.8 | 1.0 | 1.0 | 1.1 | 1.5 | 1.5 | 1.3 | 1.7 |
| Hydrodimers ($C_{12}H_{26}$)[d] | 3.7 | 3.7 | 4.6 | 3.6 | 3.8 | 3.4 | 3.5 | 2.3 |
| $C_{12}$ Alkylcyclohexanes | 16.5 | 12.0 | 13.5 | 9.8 | 9.1 | 8.3 | 6.4 | 5.2 |
| Dimethyldecalins (DMD) | 50.9 | 46.8 | 48.2 | 48.5 | 47.6 | 47.0 | 45.6 | 38.1 |
| Higher ($C_{12}H^+$) | 1.8 | 6.1 | 2.3 | 4.2 | 7.1 | 8.6 | 2.9 | 1.3 |
| Selectivity for DMD, wt %[e] | 69.1 | 69.3 | 69.3 | 72.2 | 68.9 | 68.2 | 76.4 | 78.4 |

[a]Reaction conditions: MCP/1-Hexene = 2.0 (molar); reactants addition rate, 0.3 g/min.
[b]Hydrogen transfer products (predominantly branched hexanes).
[c]Mostly alkylcyclohexanes.
[d]Branched dodecanes.
[e]Selectivity of MCP conversion into dimethyldecalins (excluding the $C_4$–$C_6$ hydrogen transfer products).

TABLE 5

Effect of Temperature upon Some Physical Properties of the $C_6^+$ Product[a]

| Experiment no. | 17 | 19 | 12 | 21 | 22 |
|---|---|---|---|---|---|
| Reaction temperature, °C. | −10 | 2 | 23 | 31 | 50 |
| Density (g/cm³ @ 15.6° C.) | 0.8538 | 0.8544 | 0.8618 | 0.8591 | 0.8575 |
| Freezing point, °C. | <−72 | <−72 | <−72 | <−72 | — |
| Hydrogen content, wt % | 13.69 | 13.58 | 13.55 | 13.43 | 13.51 |
| Net heat of combustion | | | | | |
| Btu/lb | 18,470 | 18,464 | 18,364 | 18,463 | 18,300 |
| Btu/gal | 131,600 | 131,650 | 132,200 | 132,400 | 131,000 |

[a]Total product higher than $C_6$ hydrocarbons.

TABLE 7-continued

Effect of $C_5$ Olefin Structure upon the Dehydrodimerization (DHD) vs. Ring Alkylation in the Reaction of Methylcyclopentane (MCP)[a]

| | | | | |
|---|---|---|---|---|
| MCP | 38 | 36 | 36 | 38 |
| Olefin | 15.8 | 15 | 15 | 15.4 |
| Catalyst, g 96% $H_2SO_4$ | 161.8 | 153.7 | 161.3 | 156.3 |
| Product recovered, g | | | | |
| Hydrocarbons | 49.1 | 45.0 | 45.8 | 44.7 |
| Acid layer | 164 | 155.2 | 163.1 | 162.4 |
| Losses | 2.5 | 4.5 | 3.4 | 2.6 |
| MCP conversion, wt % | 71.7 | 71.9 | 66.8 | 56.9 |
| Product distribution, wt % | | | | |
| $C_4$–$C_6$ Hydrocarbons[b] | 21.4 | 24.8 | 21.4 | 10.4[c] |

TABLE 6

Effect of $C_6$ Olefin Structure upon the Dehydrodimerization (DHD) vs. Ring Alkylation Selectivity in the Reaction of Methylcyclopentane (MCP)[a]

| Olefin Type | 1-Hexene | 4-Methyl-1-pentene | 2,3-Dimethyl-1-butene | 2,3-Dimethyl-2-butene | 3,3-Dimethyl-1-butene | Cyclohexene |
|---|---|---|---|---|---|---|
| Experiment no. | 11 | 27 | 25 | 24 | 26 | 23 |
| Reactant added, g | | | | | | |
| MCP | 36 | 36 | 36 | 36 | 36 | 38 |
| Olefin | 18 | 18 | 18 | 18 | 18 | 19 |
| Catalyst, g 96% $H_2SO_4$ | 157.4 | 166.5 | 150.6 | 153 | 146.7 | 154 |
| Product recovered, g | | | | | | |
| Hydrocarbons | 49.5 | 49.9 | 47.6 | 47.6 | 46.1 | 45.5 |
| Acid layer | 159.6 | 169.5 | 152.6 | 155 | 149.5 | 163 |
| Losses | 2.3 | 1.4 | 4.4 | 4.9 | 5.1 | 2.5 |
| MCP conversion, wt % | 74.1 | 66.5 | 64.0 | 65.0 | 64.9 | — |
| Product distribution, wt % | | | | | | |
| $C_4$–$C_6$ Hydrocarbons[b] | 30.9 | 30.9 | 31.4 | 32.5 | 41.6 | 4.6 |
| $C_7$–$C_{11}$ Hydrocarbons[c] | 1.5 | 2.3 | 11.5 | 9.3 | 5.4 | 0.4 |
| Hydrodimers ($C_{12}H_{26}$)[d] | 3.2 | 7.2 | 2.0 | 3.0 | 2.6 | — |
| $C_{12}$ Alkylcyclohexanes | 9.1 | 9.0 | 2.4 | 2.6 | 3.7 | — |
| Dimethyldecalins (DMD) | 47.6 | 45.2 | 49.3 | 49.2 | 42.9 | 88.5 |
| Higher ($C_{12}H^+$) | 7.1 | 5.4 | 3.4 | 3.4 | 3.8 | 6.5 |
| Selectivity for DMD, wt %[e] | 68.9 | 65.4 | 71.9 | 72.9 | 73.4 | 92.8 |

[a]Reaction conditions: T = 25 ± 2° C., MCP/olefin = 2.0 (molar); reactant addition rate = 0.31 g/min.
[b]Hydrogen transfer product (predominantly branched hexanes).
[c]Mostly alkylcyclohexanes.
[d]Branched dodecanes.
[e]Selectivity of MCP conversion into dimethyldecalins (excluding the $C_4$–$C_6$ hydrogen transfer products).

TABLE 7

Effect of $C_5$ Olefin Structure upon the Dehydrodimerization (DHD) vs. Ring Alkylation in the Reaction of Methylcyclopentane (MCP)[a]

| Experiment no. | 28 | 29 | 30 | 31 |
|---|---|---|---|---|
| Olefin type | 1-pentene | 2-pentene | 2-methyl-1-butene | cyclo-pentene |
| Reactant added, g | | | | |
| $C_7$–$C_9$ Hydrocarbons | 2.8 | 5.8 | 5.9 | 0.7 |
| Hydrodimers ($C_{10}H_{22}$)[d] | 3.4 | 0.9 | 5.6 | — |
| $C_{11}$ Alkylcyclo-hexanes | 14.7 | 12.4 | 12.9 | — |
| Dimethyldecalins (DMD) | 50.8 | 51.5 | 49.2 | (74.0)[e] |
| Higher ($C_{12}^+$) | 6.9 | 4.6 | 5.9 | 14.9 |
| Selectivity for DMD, | 64.6 | 68.4 | 62.6 | 82.6 |

TABLE 7-continued

Effect of $C_5$ Olefin Structure upon the Dehydrodimerization (DHD) vs. Ring Alkylation in the Reaction of Methylcyclopentane (MCP)[a]

wt %[f]

[a]Reaction conditions: T ≈ 25 ± 2° C., MCP/olefin = 2.0 (molar); reactants addition rate ≈ 0.3 g/min.
[b]Hydrogen transfer products (isopentane and cyclopentane).
[c]Mostly cyclopentane.
[d]Branched decanes.
[e]In this experiment, methyldecalins are a major component.
[f]Selectivity of MCP conversion into dimethyldecalins and methyldecalins (run 31) [excluding the $C_4$–$C_6$ hydrogen transfer products].

TABLE 10-continued

Comparison of Selectivities Self-Condensation vs. Alkylation for Methylcyclopentane (MC), cis-1,3-Dimethylcyclopentane (cis-1,3-DMCP) and Ethylcyclopentane (ECP)[a]

| | | | |
|---|---|---|---|
| Alkylcyclopentane conversion, wt % | 74.6 | ~75 | 50.9 |
| Product distribution, wt % | | | |
| $C_4$–$C_6$ Hydrocarbons[b] | 31.1 | 28.8 | 29.7 |
| $C_7$–$C_{11}$ Hydrocarbons | 1.5 | 4.2 | 11.7 |
| Hydrodimers ($C_{12}H_{26}$)[c] | 3.4 | 4.3 | 8.1 |
| Alkylcyclohexanes | 8.3[d] | 10.0[e] | 39.5[e] |
| Bicyclic naphthenes | 47.0[f] | 51.3[g] | 10.6[g] |
| Higher | 8.6 | 1.4 | 0.4 |
| Selectivity, wt %[h] | 68.2 | 72.0 | 15.1 |

TABLE 8

Change in Selectivity for Dehydrodimerization (DHD) of Methylcyclopentane (MCP) as a Function of Olefin Chain Length and Type[a]

| Experiment no. | 32 | 28 | 11 | 33 | 34 | 35 |
|---|---|---|---|---|---|---|
| Olefin type | cis-butene[b] | 1-pentene | 1-hexene | 1-heptene | 1-octene | 2,4,4-Trimethyl-1-pentene |
| Reactant added, g | | | | | | |
| MCP | 44 | 38 | 36 | 34.5 | 36 | 34.2 |
| Olefin | 14.9 | 15.8 | 18 | 20.1 | 24.5 | 22.6 |
| Catalyst, g 96% $H_2SO_4$ | 119 | 161.8 | 157.4 | 150.9 | 165.5 | 167.8 |
| Product recovered, g | | | | | | |
| Hydrocarbons | 55.5 | 49.1 | 49.5 | 50 | 56.5 | 49 |
| Acid layer | 120 | 164 | 159.6 | 152 | 168.7 | 172.2 |
| Losses | 2.4 | 2.5 | 2.3 | 3.5 | 0.8 | 3.4 |
| MCP conversion, wt % | 58.9 | 71.7 | 74.1 | 77.9 | 75.7 | 82.6 |
| Product distribution, wt % | | | | | | |
| $C_4$–$C_8$ Hydrocarbons[c] | 11.7 | 24.2 | 32.4 | 39.5 | 42.2 | 37.0 |
| Hydrodimers ($C_8$–$C_{12}$) | | 3.4 | 3.8 | — | — | — |
| Alkylcyclohexanes ($C_{10}$–$C_{14}$) | 65.5 | 14.7 | 9.1 | 52.9[d] | 8.2 | — |
| Dimethyldecalins (DMD) | 22.1 | 50.8 | 47.6 | | 41.3 | 42.5[f] |
| Higher | 0.7[g] | 6.9[g] | 7.1[g] | 7.6[h] | 8.3[i] | 4.5 |
| Selectivity for DMD, wt %[j] | 25.0 | 64.6 | 68.9 | 72.3[k] | 71.4 | 55.0[k] |

[a]In each run was used a MCP/olefin ratio of 2.0; reaction temperature 23 ± 2° C.; reactants addition rate, 0.31 g/min;
[b]In this run the gaseous olefin (cis-2-butene) was passed slowly (85 ml/min) through a liquid mixture of MCP and concentrated $H_2SO_4$; essentially no unreacted cis-2-butene was detected at the outlet of the batch reactor;
[c]Mostly hydrogen transfer products;
[d]Dimethyldecalins and $C_{13}$ alkylcyclohexanes;
[e]Mostly $C_{11}$ and $C_{12}$ alkylcyclohexanes;
[f]Included some $C_{13}$ and $C_{14}$ alkylcyclohexanes;
[g]$C_{12}^+$ hydrocarbons;
[h]$C_{13}^+$ hydrocarbons;
[i]$C_{14}^+$ hydrocarbons;
[j]Selectivity of MCP conversion into dimethyldecalins (excluding the $C_4$–$C_6$ hydrogen transfer products);
[k]Estimated value.

TABLE 9

Effect of Olefin upon the Physical Properties of $C_6^+$ Products Obtained from the Reaction of Methylcyclopentane (MCP)[a]

| Experiment no. | 32 | 28 | 31 | 23 | 12 | 34 |
|---|---|---|---|---|---|---|
| Olefin type | cis-2-butene | 1-pentene | cyclopentene | cyclohexene | 1-hexene | 1-octene |
| Density (g/cm³ @ 15.6° C.) | 0.8144 | 0.8579 | 0.8897 | 0.8779 | 0.8618 | 0.8609 |
| Freezing point, °C. | <−72 | <−72 | — | <−72 | <−72 | <−72 |
| Hydrogen content, wt % | 14.12 | 13.48 | 13.03 | 13.23 | 13.55 | 13.45 |
| Net heat of combustion | | | | | | |
| Btu/lb | 18,620 | 18,292 | 18,292 | 18,352 | 18,384 | 18,384 |
| Btu/gal | 126,500 | 131,000 | 135,800 | 134,450 | 132,200 | 132,040 |

[a]Total product higher than $C_6$ hydrocarbons.

TABLE 10

Comparison of Selectivities Self-Condensation vs. Alkylation for Methylcyclopentane (MC), cis-1,3-Dimethylcyclopentane (cis-1,3-DMCP) and Ethylcyclopentane (ECP)[a]

| Experiment no. | 12 | 36 | 36-1 |
|---|---|---|---|
| Alkylcyclopentane type | MCP | cis-1,3-DMCP | ECP |
| Reactant added, g | | | |
| Alkylcyclopentane | 36 | 0.37 | 33 |
| 1-Hexene | 18 | 0.16 | 14.5 |
| Catalyst, g 96% $H_2SO_4$ | 151.5 | 12 | 153.7 |
| Product recovered, g | | | |
| Hydrocarbons | 49.7 | ~0.5 | 40.5 |
| Acid layer | 154.2 | ~12 | 157.7 |
| Losses | 1.6 | <0.1 | 3.0 |

[a]Reaction conditions: Alkylcyclopentane/1-hexene = 2.0 (molar); reactants addition rate ≈ 0.3 g/min; reaction temperature = 22 ± 2° C.
[b]Hydrogen transfer products (predominantly branched hexanes).
[c]Branched dodecanes.
[d]Mostly $C_{12}$ Alkylcyclohexanes.
[e]Mostly $C_{13}$ Alkylcyclohexanes.
[f]Dimethyldecalins.
[g]Tetramethyldecalins.
[h]Selectivity of alkylcyclopentane conversion into bicyclic naphthenes (excluding the hydrogen transfer products).

TABLE 11

Effect of Sulfuric Acid Concentration upon the Dehydrodimerization (DHD) vs. Ring Alkylation Selectivity in the Reaction of Methylcyclopentane (MCP)[a]

| Experiment no. | 37 | 37-1 | 11 | 38 | 39 | 40 | 41 |
|---|---|---|---|---|---|---|---|
| Reactant added, g | | | | | | | |
| MCP | 36 | 36 | 36 | 36 | 36 | 36 | 36 |
| 1-Hexene | 18 | 18 | 18 | 18 | 18 | 18 | 18 |
| Catalyst, g 96% $H_2SO_4$ | 158 | 157.6 | 157.4 | 155.2 | 158.5 | 157 | 159.7 |
| Acid concentration, wt % | 100 | 98 | 96 | 94 | 92 | 90 | 80 |
| Product recovered, g | | | | | | | |
| Hydrocarbons | 49.3 | 48.6 | 49.5 | 49.2 | 48.8 | 48.8 | 41.3 |
| Acid layer | 160.2 | 160.5 | 159.6 | 158.7 | 161.7 | 160.2 | 170.2 |
| Losses | 2.5 | 2.5 | 2.3 | 1.3 | 2.0 | 2.0 | 2.0 |
| MCP conversion, wt % | 71.2 | 72.0 | 74.1 | 68.7 | 59.7 | 49.9 | 8.6 |
| Product distribution, wt % | | | | | | | |
| $C_4$-$C_6$ Hydrocarbons[b] | 34.0 | 34.0 | 30.9 | 32.8 | 34.9 | 39.2 | 24.6 |
| $C_7$-$C_{11}$ Hydrocarbons | 1.6 | 1.8 | 1.5 | 1.9 | 2.3 | 3.6 | 4.2 |
| Hydrodimers ($C_{12}H_{26}$)[c] | 3.6 | 4.1 | 3.2 | 4.1 | 6.2 | 10.0 | 48.3 |
| $C_{12}$ Alkylcyclohexanes | 8.4 | 9.7 | 9.1 | 9.4 | 12.6 | 14.7 | 6.1 |
| Dimethyldecalins (DMD) | 49.4 | 45.8 | 47.6 | 45.0 | 40.5 | 30.9 | 10.1 |
| Higher ($C_{12}^+$) | 3.0 | 4.5 | 5.3 | 6.8 | 3.5 | 1.6 | 6.5 |
| Selectivity for DMD, wt %[d] | 74.8 | 69.4 | 68.9 | 67.0 | 62.2 | 50.8 | 13.4 |

[a]Reaction conditions, T = 21 ± 2° C., MCP/1-hexene = 2.0 (molar); reactants addition rate = 0.32 g/min.
[b]Hydrogen transfer products (predominantly branched hexanes).
[c]Branched dodecanes.
[d]Selectivity of MCP conversion into dimethyldecalins (excluding the $C_4$-$C_6$ hydrogen transfer products).

TABLE 12

Effect of Catalyst/Reactant Volume Ratio upon the Dehydrodimerization (DHD) vs. Ring Alkylation Selectivity in Reaction of Methylcyclopentane (MCP)[a]

| Experiment no. | 42 | 43 | 44 | 12 | 11 | 45 | 46 |
|---|---|---|---|---|---|---|---|
| $H_2SO_4$/reactant vol. ratio | 0.22 | 0.45 | 0.74 | 1.10 | 1.14 | 1.49 | 1.97 |
| Reactant added, g | | | | | | | |
| MCP | 36 | 36 | 36 | 36 | 36 | 36 | 36 |
| 1-Hexene | 18 | 18 | 18 | 18 | 18 | 18 | 18 |
| Catalyst, 3 96% $H_2SO_4$ | 30.8 | 61.3 | 102.5 | 151.5 | 157.4 | 206.1 | 271.5 |
| Product recovered, g | | | | | | | |
| Hydrocarbons | 44.6 | 49.3 | 49.5 | 49.7 | 49.6 | 49.4 | 50 |
| Acid layer | 38.2 | 64.8 | 105.7 | 154.2 | 159.6 | 209 | 272.5 |
| Losses | 2.0 | 1.1 | 1.3 | 1.6 | 2.2 | 1.7 | 4.0 |
| MCP conversion, wt % | 64.6 | 67.3 | 72.4 | 74.6 | 74.1 | 72.3 | 70.3 |
| Product distribution, wt % | | | | | | | |
| $C_4$-$C_6$ Hydrocarbons[b] | 28.5 | 33.8 | 31.1 | 31.1 | 30.9 | 33.7 | 38.5 |
| $C_7$-$C_{11}$ Hydrocarbons | 2.5 | 1.4 | 1.6 | 1.5 | 1.5 | 1.5 | 1.1 |
| Hydrodimers ($C_{12}H_{26}$)[c] | 7.0 | 3.9 | 3.6 | 3.4 | 3.8 | 3.5 | 3.2 |
| $C_{12}$ Alkylcyclohexanes | 17.6 | 9.6 | 8.7 | 8.3 | 9.1 | 7.8 | 6.6 |
| Dimethyldecalins (DMD) | 37.0 | 44.8 | 46.2 | 47.0 | 47.6 | 48.9 | 47.7 |
| Higher ($C_{12}^+$) | 7.4 | 6.5 | 8.8 | 8.6 | 7.1 | 4.6 | 2.9 |
| Selectivity for DMD, wt %[d] | 51.7 | 67.7 | 67.1 | 68.2 | 68.9 | 73.7 | 77.6 |

[a]Reaction conditions: MCP/1-hexene = 2.0 (molar); reactants addition rate = 0.3 g/min; T = 22 ± 2° C.
[b]Hydrogen transfer products (predominantly branched hexanes).
[c]Branched dodecanes.
[d]Selectivity of MCP conversion into dimethyldecalins (excluding the $C_4$-$C_6$ hydrogen transfer products).

TABLE 13

Reaction of Methylcyclopentane (MCP) in the Presence of 1-Hexene with an $AlCl_3$-Sulfonic Acid Resin Complex as Catalyst

| Experiment no. | 47 | 48 | 49 | 50 |
|---|---|---|---|---|
| Reactant added, g | | | | |
| MCP | 22 | 22 | 1.25 | 18 |
| 1-Hexene | 11 | 11 | 11.28 | 9 |
| Catalyst, g | 5.0 | 11.9 | 3.9 | 10 |
| MCP/1-Hexene (molar) | 2.0 | 2.0 | 0.11 | 2.0 |
| Reaction temperature, °C. | 26 | 45 | 58 | 115.[a] |
| 1-Hexene addition rate, g/min | 0.256 | 0.114 | — | — |
| Product recovered, g | | | | |
| Hydrocarbons | 29 | 27 | 9.13 | 22 |
| Acid layer | 6.0 | 14.5 | 6.03 | 13.5 |
| Losses | 3.0 | 3.4 | 1.27 | 1.5 |
| MCP conversion, wt % | 11.4 | 17.1 | — | 17.1 |
| Product distribution, wt % | | | | |
| $C_4$-$C_6$ Hydrocarbons | 2.4 | 0.7 | 1.5 | 13.8 |
| $C_7$-$C_{11}$ Hydrocarbons | 2.7 | 1.1 | 34.3 | 18.2 |
| Hydrodimers ($C_{12}H_{26}$) | — | — | — | 1.2 |
| $C_{12}$ Alkylcyclohexanes | 83.0 | 92.2[b] | 64.2 | 15.6 |
| Dimethyldecalins (DMD) | — | — | — | 27.2 |
| Higher ($C_{12}^+$) | 11.9 | 6.0 | — | 24.0 |

[a]The experiments run was performed at a 150 $cm^3$ autoclave under nitrogen at a pressure of 1100 psig.
[b]Methylpentylcyclohexanes are the principal product.

TABLE 14

Effect of Catalyst Type upon the Extent of Dehydrodimerization (DHD) vs. Ring Alkylation in the Reaction of Methylcyclopentane (MCP)

| Experiment no. | 50 | 51 | 52 | 53 | 54 | 55 |
|---|---|---|---|---|---|---|
| Reactant added, g | | | | | | |
| MCP | 18 | 17.3 | 14 | 13.3 | 14 | 13.7 |
| 1-Hexene | 9 | 8.7 | 7 | 6.7 | 7 | 6.8 |
| Catalyst, g | 10 | 10.7 | 6.1 | 1.65 | 5.4 | 8.95 |
| DMD, wt %[d] | | | | | | |

TABLE 14-continued

Effect of Catalyst Type upon the Extent of Dehydrodimerization (DHD) vs. Ring Alkylation in the Reaction of Methylcyclopentane (MCP)

| Catalyst Type | $AlCl_3$-sulfonic acid resin | Mobil Dura-bead #8 | $RE^{+3}$-exchanged Y-zeolite | Hydroxy-$Al_{13}$ pillared La-montmorillonite | $SiO_2$—$Al_2O_3$ | $H_3PO_4$ on Kieselguhr |
|---|---|---|---|---|---|---|
| Pressure, psig | 1100 | 1950 | 1800 | 1700 | 2050 | 2100 |
| Reaction temperature, °C. | 115 | 190 | 195 | 190 | 190 | 225 |
| Duration time, hrs | 2.0 | 2.0 | 2.0 | 4.0 | 3.0 | 3.0 |
| Product recovered, g | | | | | | |
| Hydrocarbons | 22 | 22 | 14 | 16 | 13 | 16 |
| Catalysts | 13.5 | 11.0 | 8.5 | 3.0 | 7.3 | 9.5 |
| Losses | 1.5 | 3.7 | 4.4 | 2.65 | 6.1 | 3.95 |
| MCP conversion, wt %[a] | 17.1 | 25.4 | 34.6 | 17.7 | 42.5 | 24.9 |
| Product distribution, wt % | | | | | | |
| $C_4$-$C_6$ Hydrocarbons | 13.8 | 17.7 | 11.9 | 21.7 | 27.4 | 38.7 |
| $C_7$-$C_{11}$ Hydrocarbons | 18.2 | 4.4 | 13.4 | 7.0 | 7.3 | 9.8 |
| Hydrodimers ($C_{12}H_{26}$) | 1.2 | 3.5 | 3.0 | 2.2 | 4.7 | 7.8 |
| $C_{12}$ Alkylcyclohexanes | 15.6 | 54.7 | 50.0 | 49.9 | 42.1 | 31.5 |
| Dimethyldecalins (DMD) | 27.2 | 0.5 | 6.0 | 3.8 | 1.3 | 7.2 |
| Higher ($C_{12}^+$) | 24.0 | 19.2 | 15.8 | 15.4 | 17.2 | 5.0 |

[a]The MCP conversions in runs 51-55 were less accurately determined than in run 50, because the mass balance in these runs was only in the range of 71-87%.

TABLE 15

Effect of Cetylamine Additive upon the Dehydrodimerization (DHD) vs Alkylation Selectivity in the Reaction of Methylcyclopentane (MCP)[a]

| Experiment no. | 12 | 56 | 57 |
|---|---|---|---|
| Reactant added, g | | | |
| MCP | 36 | 36 | 36 |
| 1-Hexene | 18 | 18 | 18 |
| Catalyst, g 96% $H_2SO_4$ | 151.5 | 157.6 | 160 |
| Cetylamine, additive, g | 0 | 0.016 | 0.032 |
| Product recovered, g | | | |
| Hydrocarbons | 49.7 | 49.9 | 53.7[b] |
| Acid layer | 154.2 | 159.1 | 158 |
| Losses | | | |
| MCP conversion, wt % | 74.6 | 74.5 | 74.0[c] |
| Product distribution, wt % | | | |
| $C_4$-$C_6$ Hydrocarbons[d] | 31.1 | 31.0 | 31.4 |
| $C_7$-$C_{11}$ Hydrocarbons[e] | 1.5 | 1.4 | 1.5 |
| Hydrodimers ($C_{12}H_{26}$)[f] | 3.4 | 3.3 | 3.2 |
| $C_{12}$ Alkylcyclohexanes | 8.3 | 8.3 | 7.9 |
| Dimethyldecalins (DMD) | 47.0 | 50.9 | 49.6 |
| Higher ($C_{12}^+$) | 8.6 | 5.1 | 6.4 |
| Selectivity for DMD, wt %[g] | 68.2 | 73.8 | 72.4 |

[a]Reaction conditions: MCP/1-hexene = 2.0 (molar); T ≈ 23 ± 2° C.; reactants addition rate ≈ 0.3 g/min.
[b]Includes some alkylsulfate or dialkylsulfate (alkyl esters).
[c]Estimated value.
[d]Hydrogen transfer products (predominantly branched hexanes).
[e]Mostly alkylcyclohexanes.
[f]Branched dodecanes.
[g]Selectivity of MCP conversion into dimethyldecalins (excluding the $C_4$-$C_6$ hydrogen transfer products).

TABLE 16

Effect of $CF_3SO_3H$ Promoter upon the Dehydrodimerization (DHD) vs. Alkylation Selectivity in the Reaction of Methylcyclopentane (MCP)[a]

| Experiment no. | 11 | 12 | 58 | 59 | 60 |
|---|---|---|---|---|---|
| Reactant added, g | | | | | |
| MCP | 36 | 36 | 36 | 36 | 36 |
| 1-Hexene | 18 | 18 | 18 | 18 | 18 |
| Catalyst, g 96% $H_2SO_4$ | 157.4 | 151.5 | 156.8 | 153.6 | 150.4 |
| Promoter, g $CF_3SO_3H$ | 0 | 0 | 3.2 | 6.4 | 9.6 |
| Product recovered, g | | | | | |
| Hydrocarbons | 49.5 | 49.7 | 49.6 | 49.3 | 48.9 |
| Acid layer | 159.5 | 154.2 | 161.8 | 162.3 | 162.1 |
| Losses | 2.3 | 1.6 | 2.0 | 2.4 | 3.0 |
| MCP conversion, wt % | 74.1 | 74.6 | 72.9 | 73.2 | 74.4 |
| Product distribution, wt % | | | | | |

TABLE 16-continued

Effect of $CF_3SO_3H$ Promoter upon the Dehydrodimerization (DHD) vs. Alkylation Selectivity in the Reaction of Methylcyclopentane (MCP)[a]

| | | | | | |
|---|---|---|---|---|---|
| $C_4$-$C_6$ Hydrocarbons[b] | 30.9 | 31.1 | 32.2 | 31.8 | 31.3 |
| $C_7$-$C_{11}$ Hydrocarbons | 1.5 | 1.5 | 1.6 | 1.6 | 1.7 |
| Hydrodimers ($C_{12}H_{26}$)[c] | 3.8 | 3.4 | 3.5 | 3.7 | 3.5 |
| $C_{12}$ Alkylcyclohexanes | 9.1 | 8.3 | 8.6 | 8.9 | 8.5 |
| Dimethyldecalins (DMD) | 47.6 | 47.0 | 47.4 | 49.0 | 48.3 |
| Higher ($C_{12}^+$) | 7.1 | 8.6 | 6.7 | 4.9 | 6.7 |
| Selectivity for DMD, wt %[d] | 68.9 | 68.2 | 69.9 | 71.8 | 70.3 |

[a]Reaction conditions: MCP/1-hexene = 2.0 (molar); T = 21 ± 2° C.; reactants addition rate = 0.32 g/min.
[b]Hydrogen transfer products (predominantly branched hexanes).
[c]Branched dodecanes.
[d]Selectivity of MCP conversion into dimethyldecalins (excluding the $C_4$-$C_6$ hydrogen transfer products).

TABLE 17

GC/MS Results on Products from the Reactions of Methylcyclopentane (MCP) in the Presence of 1-Hexene[a]

| Product (type) | Molecular peak, M/e | Major fragmentation peaks, m/e[b] |
|---|---|---|
| 2- and 3-Methyl-pentane | 86 | 57 (100), 56 (72), 41 (46), 43 (35), 42 (4.3), 71 (4.1), 39 (3.3) |
| $C_7H_{16}$ (heptane) | 100 | 43 (100), 32 61), 41 (40), 57 (32), 39 (8), 40 (7), 42 (5) |
| Methylcyclo-hexane | 98 | 83 (100), 55 (39), 32 (33), 98 (23), 42 (13), 56 (12.5), 70 (10) |
| 1,3-dimethyl-cyclohexane | 112 | 55 (100), 32 (92), 97 (30), 112 (26), 56 (18), 41 (17), 39 (10) |
| $C_9H_{20}$ (nonane) | 128 | 57 (100), 32 (100), 55 (59), 40 (58), 56 (30), 41 (25), 43 (9) |
| $C_9H_{20}$ (nonane) | 128 | 57 (100), 32 (79), 55 (75), 41 (69), 56 (56), 83 (39), 71 (29), 43 (24) |
| $C_9H_{20}$ (nonane) | 128 | 71 (100), 57 (42), 43 (19), 41 (17), 70 (15), 40 (12), 55 (10) |
| $C_9H_{20}$[c] (nonane) | 128 | 43 (100), 97 (35), 57 (33), 41 (31), 55 (19), 69 (16), 40 (13) |
| $C_{10}H_{22}$ (decane) | 142 | 57 (100), 56 (19), 71 (10), 40 (8), 43 (5), 55 (5) |
| $C_{11}H_{24}$ (undecane) | 156 | 71 (100), 57 (47), 40 (35), 55 (27), 69 (20), 41 (15), 43 (13), 111 (12) |
| $C_{11}H_{24}$ (undecane) | 156 | 71 (100), 55 (50), 57 (48), 40 (31), 41 (17), 43 (15) |
| $C_{12}H_{26}$ (dodecane) | 170 | 57 (100), 56 (18), 71 (12), 55 (8), 40 (7), 41 (5), 43 (4) |
| $C_{12}H_{26}$ | 170 | 57 (100), 71 (54), 56 (28), 55 (25), |

TABLE 17-continued

GC/MS Results on Products from the Reactions of Methylcyclopentane (MCP) in the Presence of 1-Hexene[a]

| Product (type) | Molecular peak, M/e | Major fragmentation peaks, m/e[b] |
|---|---|---|
| (dodecane) | | 40 (23), 83 (20), 41 (18) |
| $C_{11}H_{22}$ (alkylcyclohexane) | 154 | 69 (100), 111 (23), 83 (12), 41 (9), 55 (8), 57 (6), 139 (5) |
| $C_{12}H_{26}$ (dodecane) | 170 | 57 (100), 69 (21), 55 (19), 83 (13), 56 (12.5), 71 (12), 41 (7) |
| $C_{12}H_{26}$ (dodecane) | 170 | 57 (100), 56 (33), 71 (9), 55 (7), 69 (5), 43 (4) |
| $C_{12}H_{26}$ (dodecane) | 170 | 57 (100), 56 (15), 71 (12), 55 (7), 41 (6), 69 (5), 85 (4), 43 (4) |
| $C_{12}H_{24}$ (alkyl-cyclohexane) | 168 | 69 (100), 57 (96), 83 (25), 55 (15), 56 (14), 97 (12), 153 (11) |
| $C_{12}H_{24}$ (alkyl-cyclohexane) | 168 | 69 (100), 111 (26), 57 (25), 55 (15), 97 (15), 83 (12), 71 (12) |
| $C_{12}H_{26}$ (dodecane) | 170 | 57 (100), 71 (23), 69 (20), 55 (17), 56 (13), 70 (10), 43 (9), 70 (4) |
| $C_{12}H_{26}$ (dodecane) | 170 | 57 (100), 71 (24), 55 (22), 69 (21), 56 (13), 70 (11), 111 (10), 83 (10) |
| $C_{12}H_{24}$ (alkyl-cyclohexane) | 168 | 69 (100), 111 (74), 43 (13), 97 (10), 41 (8), 125 (7), 83 (6), 55 (6) |
| $C_{12}H_{24}$ (alkyl-cyclohexane) | 168 | 69 (100), 125 (17), 111 (16), 83 (16), 57 (10), 97 (9), 55 (7), 40 (7) |
| $C_{12}H_{24}$ (alkyl-cyclohexane) | 168 | 69 (100), 83 (16), 125 (15), 111 (15), 97 (8), 55 (7), 57 (6) |
| $C_{12}H_{24}$ (alkyl-cyclohexane) | 168 | 69 (100), 83 (24), 57 (21), 55 (19), 111 (14), 70 (7), 71 (7), 125 (6) |
| $C_{12}H_{24}$ (alkyl-cyclohexane) | 168 | 69 (100), 83 (47), 97 (42), 125 (38), 111 (23), 55 (15), 43 (14), 41 (12) |
| $C_{12}H_{24}$ (alkyl-cyclohexane) | 168 | 69 (100), 83 (92), 55 (43), 57 (42), 97 (22), 111 (18), 56 (17), 70 (15) |
| $C_{12}H_{24}$ (alkyl-cyclohexane) | 168 | 69 (100), 55 (98), 83 (83), 57 (48), 97 (23), 70 (21), 56 (18), 111 (17) |
| $C_{12}H_{24}$ (alkyl-cyclohexane) | 168 | 69 (100), 83 (59), 55 (48), 57 (30), 70 (22), 111 (21), 40 (21), 97 (19) |
| x,x-Dimethyl-decalin | 166 | 95 (100), 166 (51), 83 (45), 69 (43), 55 (40), 109 (32), 81 (23), 67 (17) |
| x,x-Dimethyl-decalin | 166 | 166 (100), 95 (96), 67 (65), 81 (58), 82 (57), 109 (56), 69 (53), 151 (45) |
| x,x-Dimethyl-decalin | 166 | 81 (100), 95 (88), 151 (87), 55 (84), 41 (44), 96 (32), 67 (26), 166 (74) |
| x,x-Dimethyl-decalin | 166 | 166 (100), 95 (92), 109 (90), 71 (49), 83 (48), 67 (48), 81 (36), 68 (30) |
| x,x-Dimethyl-decalin | 166 | 95 (100), 55 (38), 166 (27), 109 (23), 81 (21), 69 (21), 83 (17), 151 (14) |
| x,x-Dimethyl-decalin | 166 | 81 (100), 151 (51), 41 (44), 67 (37), 97 (32), 95 (28), 55 (26), 82 (18) |
| x,x-Dimethyl-decalin | 166 | 109 (100), 95 (64), 166 (63), 69 (44), 97 (26), 67 (25), 68 (24), 82 (18) |
| x,x,x-Trimethyl-decalin | 180 | 151 (100), 81 (80), 41 (57), 67 (45), 95 (33), 55 (27), 97 (22), 43 (22) |
| x,x,x-Trimethyl-decalin | 180 | 81 (100), 151 (55), 67 (51), 41 (43), 95 (41), 69 (27), 137 (23), 109 (22) |
| $C_{18}H_{34}$[f] | 250 | 57 (100), 83 (80), 69 (79), 95 (67), 55 (54), 71 (47), 109 (35), 97 (24) |
| $C_{18}H_{34}$[f] | 250 | 69 (100), 109 (61), 83 (43), 97 (42), 40 (41), 95 (39), 111 (36), 125 (29) |
| $C_{18}H_{34}$[f] | 250 | 69 (100), 109 (87), 83 (58), 95 (55), 97 (53), 111 (47), 235 (37), 123 (44) |
| $C_{18}H_{34}$[f] | 250 | 69 (100), 109 (80), 95 (57), 83 (45), 97 (43), 111 (37), 123 (33), 125 (27) |
| $C_{18}H_{34}$[f] | 250 | 69 (100), 109 (95), 95 (61), 83 (44), 97 (43), 123 (40), 111 (38), 125 (28) |
| $C_{18}H_{34}$[f] | 250 | 95 (100), 83 (67), 55 (62), 109 (60), 57 (55), 69 (54), 165 (40), 81 (18) |
| $C_{18}H_{34}$[f] | 250 | 109 (100), 69 (83), 95 (67), 83 (37), 123 (36), 151 (33), 40 (28), 81 (17) |
| $C_{18}H_{34}$[g] | 248 | 95 (100), 109 (38), 83 (37), 163 (36), 69 (35), 55 (31), 81 (17), 135 (16) |
| $C_{18}H_{34}$[g] | 248 | 109 (100), 95 (70), 248 (68), 69 (48), 163 (37), 123 (36), 83 (30), 40 (20) |
| $C_{18}H_{34}$[g] | 248 | 109 (100), 95 (66), 248 (48), 163 (32), 69 (29), 205 (27), 219 (25), 123 (25) |
| $C_{18}H_{34}$[g] | 248 | 95 (100), 109 (79), 83 (32), 205 (25), 219 (22), 81 (21), 55 (20), 135 (19) |

[a]Products obtained in experiment no. 2;
[b]Relative intensities given in parentheses (arranged in the order of decreasing intensity);
[c]Mixture of $C_9$ isoparaffin and $C_9$ alkylcyclohexane;
[d]Mixture of $C_{11}$ alkylcyclohexane and $C_{12}$ isoparaffin;
[e]Mixture of $C_{12}$ isoparaffin and $C_{12}$ alkylcyclohexane;
[f]Alkyldecalins;
[g]Tricyclic naphthenes.

TABLE 18

GC/MS Results on Products from the Reactions of Methylcyclopentane (MCP) in the Presence of 1-Hexene[a]

| Product (type) | Molecular peak, M/e | Major fragmentation peaks, m/e[b] |
|---|---|---|
| Methylpentanes | 86 | 57 (100), 56 (89), 41 (47), 43 (36), 42 (5), 71 (4), 55 (3), 39 (3) |
| Cyclohexane | 84 | 56 (100), 84 (78), 41 (45), 55 (15), 69 (14), 42 (12), 39 (5) |
| Methylcyclo-hexane | 98 | 83 (100), 55 (79), 41 (46), 98 (43), 69 (35), 56 (17), 40 (17), 42 (15) |
| Dimethylbutyl-cyclohexane | 168 | 69 (100), 111 (77), 55 (54), 40 (25), 57 (18), 43 (16), 83 (15), 41 (13) |
| Dimethylbutyl-cyclohexane | 168 | 69 (100), 97 (93), 55 (92), 111 (69), 40 (32), 83 (22), 57 (16) |
| Dimethylbutyl-cyclohexane | 168 | 69 (100), 111 (80), 55 (61), 40 (26), 97 (19), 83 (15), 41 (13) |
| Methyl-n-pentyl-cyclohexane(1) | 168 | 97 (100), 55 (74), 96 (26), 69 (9), 168 (7), 41 (5), 98 (5), 83 (5) |
| Methyl-n-pentyl-cyclohexane(2) | 168 | 97 (100), 55 (49), 69 (12), 96 (9), 83 (7), 41 (6), 168 (5), 43 (4) |
| Methyl-n-pentyl-cyclohexane(3) | 168 | 97 (100), 55 (30), 96 (13), 69 (9), 41 (7), 83 (6), 56 (6), 43 (5) |
| Dimethyl-di-n-pentylcyclohexane | 252 | 97 (100), 83 (87), 69 (66), 111 (63), 55 (62), 57 (50), 41 (30), 71 (29) |

[a]A solid catalyst ($AlCl_3$-sulfonic acid resin complex) was used in this run (experiment 48, Table 13).
[b]Relative intensities given in parentheses (arranged in the order of decreasing intensity).

TABLE 19

GC/MS Results on Products from the Reactions of Methylcyclopentane (MCP) in the Presence of 2-Pentene[a]

| Product (type) | Molecular peak, M/e | Major fragmentation peaks, m/e[b] |
|---|---|---|
| 2-Methylbutane | 72 | 43 (100), 42 (100), 41 (80), 57 (66), 40 (35), 56 (16) |
| Methylpentanes | 86 | 57 (100), 43 (64), 41 (54), 56 (54), 42 (14), 86 (6) |
| Cyclohexane | 84 | 56 (100), 84 (32), 41 (20), 69 (15), 55 (14), 42 (12) |
| Methylcyclo-hexane | 98 | 83 (100), 55 (31), 41 (20), 98 (18), 42 (12), 69 (12), 70 (10), 56 (10) |
| $C_{10}H_{22}$ (Dodecane) | 142 | 57 (100), 56 (82), 43 (56), 71 (37), 40 (35), 85 (31), 41 (27), 55 (5) |

TABLE 19-continued

GC/MS Results on Products from the Reactions of Methylcyclopentane (MCP) in the Presence of 2-Pentene[a]

| Product (type) | Molecular peak, M/e | Major fragmentation peaks, m/e[b] |
|---|---|---|
| $C_{10}H_{22}$ (Dodecane) | 142 | 57 (100), 56 (86), 43 (46), 41 (43), 71 (41), 40 (35), 85 (28), 55 (6) |
| $C_{10}H_{22}$ (Dodecane) | 142 | 71 (100), 57 (84), 43 (72), 40 (35), 70 (34), 41 (26), 113 (9), 55 (7) |
| $C_{10}H_{22}$ (Dodecane) | 142 | 57 (100), 43 (43), 40 (35), 71 (26), 56 (11), 41 (11), 70 (9), 85 (7) |
| $C_{10}H_{20}$ (Alkyl-cyclohexane) | 140 | 69 (100), 55 (87), 57 (71), 70 (67), 56 (62), 41 (58), 83 (57), 40 (56), 125 (55) |
| $C_{11}H_{22}$ (Alkyl-cyclohexane) | 154 | 69 (100), 139 (22), 83 (21), 111 (20), 55 (18), 57 (9), 41 (8), 43 (7) |
| $C_{11}H_{22}$ (Alkyl-cyclohexane) | 154 | 69 (100), 111 (28), 55 (27), 41 (13), 83 (10), 110 (9), 57 (8), 154 (7) |
| $C_{11}H_{22}$ (Alkyl-cyclohexane) | 154 | 69 (100), 55 (83), 97 (46), 111 (44), 41 (29), 125 (21), 40 (19), 57 (18) |
| x,x-Dimethyl-decalin | 166 | 95 (100), 81 (91), 166 (73), 151 (61), 55 (49), 109 (20), 96 (16), 41 (15) |
| x,x-Dimethyl- | 166 | 95 (100), 166 (63), 81 (54), 151 (47), 55 (45), 109 (18), 41 (15), 96 (14) |

TABLE 20

GC/MS Results on Products from the Reactions of Methylcyclopentane (MCP) in the Presence of Cyclohexene[a]

| Product (type) | Molecular peak, M/e | Major fragmentation peaks, m/e[b] |
|---|---|---|
| 2-Methylpentane | 86 | 43 (100), 42 (54), 32 (26), 71 (17.7), 41 (16), 57 (7) |
| 3-Methylpentane | 86 | 57 (100), 32 (83), 43 (70), 41 (67), 56 (47), 42 (34), 86 (8) |
| Cyclohexane | 84 | 56 (100), 40 (80), 84 (77), 41 (47), 44 (39), 55 (34), 69 (30) |
| Methylcyclohexane | 98 | 40 (100), 83 (45), 55 (32), 44 (30), 41 (22), 98 (21), 56 (15), 42 (12) |
| x,x-Dimethyl-decalin | 166 | 95 (100), 81 (97), 40 (72), 166 (71), 151 (60), 41 (49), 67 (47), 109 (40) |
| x,x-Dimethyl-decalin | 166 | 95 (100), 81 (84), 151 (70), 166 (64), 67 (50), 55 (50), 41 (43), 39 (38) |
| x,x-Dimethyl-decalin | 166 | 95 (100), 166 (97), 81 (93), 67 (70), 109 (68), 55 (59), 41 (58), 96 (51) |
| $C_{18}H_{32}$[c] | 248 | 81 (100), 95 (87), 67 (73), 41 (59), 109 (52), 248 (51), 55 (45), 69 (41) |
| $C_{18}H_{32}$[c] | 248 | 95 (100), 81 (87), 109 (39), 55 (35), 96 (30), 248 (27), 67 (25), 69 (23) |

[a]Products obtained in experiment 23 (Table 6).
[b]Relative intensities given in parentheses (arranged in the order of decreasing intensity).
[c]Tricyclic naphthenes.

TABLE 21

GC/MS Results on Products from the Reactions of Methylcyclopentane (MCP) in the Presence of Cyclopentene[a]

| Product (type) | Molecular peak, M/e | Major fragmentation peaks, m/e[b] |
|---|---|---|
| 2- and 3-Methyl-pentanes | 86 | 57 (100), 43 (97), 41 (76), 56 (68), 42 (67), 86 (30), 55 (7), 39 (7) |
| Cyclohexane | 84 | 56 (100), 84 (78), 41 (44), 40 (34), 69 (31), 55 (30), 42 (24), 39 (11) |
| Methylcyclo-hexane | 98 | 83 (100), 55 (73), 98 (48), 41 (34), 56 (26), 70 (22), 69 (21), 40 (21) |
| x-Methyldecalin | 152 | 95 (100), 67 (40), 136 (31), 94 (24), 68 (21), 121 (17), 41 (17) |
| x-Methyldecalin[c] | 152 | 81 (100), 152 (92), 95 (74), 67 (64), 82 (48), 137 (45), 55 (44), 68 (36), 96 (34) |
| x-Methyldecalin | 152 | 152 (100), 81 (58), 95 (57), 67 (53), 82 (52.6), 96 (34), 151 (31), 55 (29) |
| x-Methyldecalin | 152 | 152 (100), 82 (81), 95 (76), 67 (72), 81 (64), 96 (61), 55 (40), 41 (35) |
| Dimethyldecalin | 166 | 95 (100), 151 (83), 166 (69), 81 (68), 40 (52), 55 (47), 67 (42), 109 (28), 82 (27) |
| Dimethyldecalin | 166 | 109 (100), 166 (95), 95 (80), 81 (72), 67 (57), 55 (55), 40 (52), 82 (49) |
| $C_{16}H_{28}$ | 220 | 95 (100), 220 (97), 135 (79), 81 (77), 67 (56), 191 (49), 55 (45), 109 (43), 41 (37) |

[a]Products obtained in experiment 31 (Table 7).
[b]Relative intensities given in parentheses (arranged in the order of decreasing intensity).
[c]Trans-anti-2-methyldecalin.

TABLE 22

GC/MS Results on Products from the Reactions of Methylcyclopentane (MCP) in the Presence of 1-Octene[a]

| Product (type) | Molecular peak, M/e | Major fragmentation peaks, m/e[b] |
|---|---|---|
| $C_8H_{18}$ (Octane) | 114 | 57 (100), 55 (13), 71 (11), 70 (10), 99 (6), 56 (5), 83 (3) |
| $C_8H_{18}$ (Octane) | 114 | 57 (100), 85 (62), 56 (13), 84 (12), 55 (6), 71 (5.5), 70 (5) |
| $C_8H_{18}$ (Octane) | 114 | 57 (100), 55 (93), 56 (56), 85 (53.5), 71 (53), 70 (30), 84 (16) |
| $C_8H_{16}$ (Alkyl-cyclohexane) | 112 | 55 (100), 97 (95), 56 (39), 69 (29), 70 (28), 57 (27), 112 (16), 83 (15) |
| $C_8H_{16}$ (Alkyl-cyclohexane) | 112 | 83 (100), 55 (100), 56 (49), 69 (28), 82 (28), 71 (27), 70 (26) |
| $C_9H_{18}$ (Alkyl-cyclohexane) | 126 | 55 (100), 97 (83), 57 (35), 69 (23), 56 (12), 83 (12), 85 (11), 67 (6) |
| $C_9H_{18}$ (Alkyl-cyclohexane) | 126 | 55 (100), 57 (89), 83 (88), 82 (38), 69 (31), 71 (28), 56 (27), 85 (19) |
| $C_9H_{18}$ (Alkyl-cyclohexane) | 126 | 55 (100), 97 (71), 57 (67), 69 (29), 56 (18), 85 (14), 71 (13), 96 (10) |
| x,x-Dimethyl-decalin | 166 | 95 (100), 81 (91), 67 (57), 55 (56.5), 151 (53), 166 (40), 83 (38), 82 (37) |
| x,x-Dimethyl-decalin | 166 | 95 (100), 81 (47), 67 (38), 166 (33), 109 (33), 151 (31), 69 (31), 82 (30) |
| x,x-Dimethyl-decalin | 166 | 81 (100), 109 (81), 95 (77), 67 (72), 82 (60), 55 (56), 166 (55), 151 (49) |
| x,x-Dimethyl-decalin | 166 | 81 (100), 67 (85), 95 (79), 166 (74), 151 (72), 55 (71), 82 (66), 109 (48) |
| x,x-Dimethyl-decalin | 166 | 95 (100), 109 (99.6), 69 (64), 81 (59), 67 (52), 68 (46), 166 (45), 82 (40) |
| $C_{14}H_{28}$ (Alkyl-cyclohexane) | 196 | 69 (100), 83 (58), 55 (48), 97 (38), 111 (35), 57 (24), 126 (16), 95 (14) |
| $C_{16}H_{34}$ (Hexadecane) | 226 | 57 (100), 71 (63), 85 (35), 55 (17), 56 (11), 69 (11), 70 (10), 97 (9), 99 (8) |
| $C_{18}H_{32}$[c] | 248 | 109 (100), 81 (89), 95 (88), 55 (82), 123 (68), 67 (60), 219 (59), 248 (55) |

[a]Products obtained in experiment no. 34 (Table 7).
[b]Relative intensities given in parentheses (arranged in the order of decreasing intensity).
[c]Tricyclic naphthenes.

TABLE 23

GC/MS Results on Products from the Reactions of Ethylcyclopentane (ECP) in the Presence of 1-Hexane[a]

| Product (type) | Molecular peak, M/e | Major fragmentation peaks, m/e[b] |
|---|---|---|
| 2-Methylbutane | 72 | 43 (100), 42 (85), 57 (69), 41 (61), 40 (36), 56 (10), 39 (6) |
| Methylpentanes | 86 | 57 (100), 56 (86), 41 (53), 43 (32), 39 (4), 55 (3.4), 42 (3) |
| Cyclohexane | 84 | 56 (100), 84 (76), 41 (45), 55 (35), 69 (29), 40 (27), 42 (12) |
| Cis-1,3-Dimethyl-cyclohexane | 112 | 97 (100), 55 (85), 40 (78), 41 (15), 112 (14), 69 (12), 56 (11), 42 (8) |
| Ethylcyclohexane | 112 | 83 (100), 55 (71), 57 (51), 82 (42), 41 (36), 56 (34), 112 (22), 43 (19) |
| $C_9H_{20}$ (Nonane) | 128 | 71 (100), 57 (59), 40 (27), 43 (27), 70 (11), 41 (9), 113 (7), 55 (7) |
| $C_{10}H_{22}$ (Decane) | 142 | 57 (100), 83 (75), 55 (60), 56 (59), 43 (53), 41 (41), 82 (40), 85 (32) |
| $C_{11}H_{24}$ (Undecane) | 156 | 57 (100), 40 (50), 43 (23), 71 (21), 56 (14), 55 (12), 41 (11), 97 (8) |
| $C_{12}H_{26}$ (Dodecane) | 170 | 57 (100), 43 (76), 71 (66), 56 (57), 85 (54), 41 (39), 55 (31), 69 (30) |
| $C_{12}H_{26}$ (Dodecane) | 170 | 57 (100), 43 (78), 71 (76), 85 (38), 41 (31), 56 (28), 40 (27), 55 (12) |
| $C_{12}H_{26}$ (Dodecane) | 170 | 57 (100), 43 (32), 40 (32), 69 (32), 71 (29), 55 (18), 85 (15), 83 (14) |
| $C_{12}H_{24}$ (Alkyl-cyclohexane) | 168 | 69 (100), 40 (88), 55 (41), 83 (39), 97 (34), 56 (26), 41 (24), 111 (19) |
| Methylethylbutyl-cyclohexane | 182 | 69 (100), 36 (89), 111 (83), 55 (77), 97 (57), 41 (43), 83 (38), 125 (29) |
| Dimethylethyl-propylcyclo-hexane | 182 | 97 (100), 55 (85), 69 (72), 56 (61), 111 (45), 83 (43), 41 (39), 43 (24) |
| $C_{14}H_{26}$ (Tetra-methyldecalin) | 194 | 95 (100), 69 (92), 55 (89), 81 (60), 82 (60), 111 (55), 109 (51), 41 (48) |
| $C_{14}H_{26}$ (Tetra-methyldecalin) | 194 | 69 (100), 55 (83), 111 (71), 40 (33.2), 111 (27), 82 (26), 97 (24), 81 (22) |

[a]Products obtained in experiment no. 36 (Table 10).
[b]Relative intensities given in parentheses (arranged in the order of decreasing intensity).

What is claimed is:

1. A method of making jet fuel compositions having high density, high heat of combustion and low freezing point via a dehydrocondensation reaction comprising:

reacting a cyclopentane containing a lower alkyl group with a $C_5$ to $C_8$ olefin in the presence of concentrated sulfuric acid or HF at a temperature of about −10° C. to about 50° C. said alkyl group having one to three carbon atoms.

2. The method of claim 1 wherein the temperature of reaction is from about 0° C. to about 40° C.

3. The method of claim 1 wherein the temperature of reaction is from about 20° C. to about 30° C.

4. The method of claim 1 wherein the molar ratio of alkylcyclopentane reactant to olefin reactant is from about 0.5:1 to about 20:1.

5. The method of claim 1 wherein the molar ratio of cyclopentane reactant to olefinic reactant is from about 2:1 to about 15:1.

6. The method of claim 1 wherein the molar ratio of cyclopentane reactant to olefinic reactant is from about 3:1 to about 10:1.

7. The method of claim 1 wherein the alkyl group is methyl or ethyl.

8. The method of claim 1 wherein the $C_5$–$C_8$ olefin is a $C_5$–$C_6$ olefin.

9. The method of claim 8 wherein the olefin is cyclopentene or cyclohexene.

10. The method of claim 1 wherein said cyclopentane is dimethyl cyclopentane.

11. A jet fuel composition comprising:

decalins present as at least about 35% of the composition; and alkylated single ring naphthenes present as at least about 4% of the composition.

* * * * *

UNITED STATES PATENT AND TRADEMARK OFFICE

CERTIFICATE OF CORRECTION

PATENT NO. : 5,189,232

DATED : 2/23/93

INVENTOR(S) : Shabtai et al.

It is certified that error appears in the above-indentified patent and that said Letters Patent is hereby corrected as shown below:

In Column 1, line 65, change "uC" to --$^{13}$C--;

In Column 2, line 54, delete the colon after "($C_5$-$C_8$)";

In Column 3, line 56, change "result" to --results--;

In Column 3, line 57, change "is" to --vs--;

In Column 4, line 6, change "summaries" to --summarizes--;

In Column 4, line 14, change "support1" to --support;--

In Column 4, line 17, change "i-hexene" to --1-hexene--;

In Column 4, line 43, change "Was" to --was--;

In Column 4, line 66, change "(MCp)" to --(MCP)--;

In Column 5, line 9, change "te¢" to --te ≈;

In Column 5, line 15, change "$Cu_{12}$ +" to --$C_{12}$+--;

In Column 5, line 42, change "produce" to --product--;

In Column 5, line 64, change "extend" to --extent--;

In Column 6, line 18, change "C." (second occurrence) to --$C_6$+--;

In Column 6, line 50, change "3,3-dimethyl-i-butene" to --3,3-dimethyl-1-butene--;

In Column 6, line 63, change "a" to --as--;

In Column 6, line 65, change "(2-methyl-i-butene)" to --(2-methyl-1-butene)--;

In Column 7, line 55, change "of" (second occurrence) to --and--;

UNITED STATES PATENT AND TRADEMARK OFFICE

CERTIFICATE OF CORRECTION

PATENT NO. : 5,189,232

DATED : 2/23/93

INVENTOR(S) : Shabtai et al.

It is certified that error appears in the above-indentified patent and that said Letters Patent is hereby corrected as shown below:

In Column 8, line 51, change "15°" to --115°--;

In Column 9, line 6, change "$La^{'+}$" to --$La^{3+}$--;

In Column 9, line 25, change "oetryltrimethylammonium" to --cetyltrimethylammonium--;

In Column 9, line 48, change "i-hex-" to --1-hex- --;

In Column 9, line 65, delete "and";

In Column 9, line 65, after "bath" insert --3, thermostat 4, gas collecting buret 7, water test meter 8 and vent 9--;

In Column 9, line 66, after "(FIG. 6)" delete "; and" and insert a period therefor;

In Column 10, line 37, change "I500" to --1500--;

In Column 10, line 45, insert a period after "acid";

In Column 15, Table 8, line 4 of the table, change "cis-butene[b]" to --cis-2-butene[b]--;

In Column 18, Table 12, line 8 of the table, change "catalyst, 3" to --catalyst, g--;

In Column 22, Table 17 (cont.), line 11, change "$C_{18}H_{34}$ G" to --$C_{18}H_{32}$[g] --.

In Column 22, Table 17 (cont.), line 14, change "$C_{18}H_{34}$ G" to --$C_{18}H_{32}$[g] --.

In Column 22, Table 17 (cont.), line 16, change "$C_{18}H_{34}$ G" to --$C_{18}H_{32}$[g]--.

In Column 22, Table 17 (cont.), line 18, change "$C_{18}H_{34}$ G" to --$C_{18}H_{32}$[g]--.

In Column 23, Table 19 (cont.), line 25, change the last "x,x-Dimethyl-" to --x,x-Dimethyl-decalin--;

UNITED STATES PATENT AND TRADEMARK OFFICE

CERTIFICATE OF CORRECTION

PATENT NO. : 5,189,232

DATED : 2/23/93

INVENTOR(S) : Shabtai et al.

It is certified that error appears in the above-indentified patent and that said Letters Patent is hereby corrected as shown below:

In Column 23, Table 19, insert the following portion that was omitted:

Table 19, cont.

| | | |
|---|---|---|
| x,x-Dimethyldecalin | 166 | 95 (100), 166 (95), 81 (82), 109 (76), 55 (61), 96 (27), 110 (22), 41 (20) |
| $C_{17}H_{32}$ (Alkyldecalin) | 236 | 95 (100), 109 (93), 69 (92), 55 (66), 81 (61), 83 (58), 123 (56), 41 (50), 111 (45) |
| $C_{18}H_{32}$[c] | 248 | 109 (100), 95 (79), 219 (75), 123 (71), 248 (66), 81 (63), 55 (46), 205 (41) |

[a]Products obtained in experiment 28 (Table 7).
[b]Relative intensities given in parentheses (arranged in the order of decreasing intensity).
[c]Tricyclic naphthenes.

Signed and Sealed this

Fifth Day of July, 1994

Bruce Lehman

*Attest:*

BRUCE LEHMAN

*Attesting Officer*

*Commissioner of Patents and Trademarks*